US010259642B2

(12) United States Patent
Wonderley et al.

(10) Patent No.: US 10,259,642 B2
(45) Date of Patent: Apr. 16, 2019

(54) BLADE DISPENSER

(71) Applicant: AccuTec Blades Inc., Verona, VA (US)

(72) Inventors: Jeffrey W. Wonderley, Fort Defiance, VA (US); Paul Phillipp Erdmann, Shueng Wan (HK)

(73) Assignee: ACCUTEC BLADES, INC., Verona, VA (US)

( * ) Notice: Subject to any disclaimer, the term of this patent is extended or adjusted under 35 U.S.C. 154(b) by 0 days.

(21) Appl. No.: 15/380,773

(22) Filed: Dec. 15, 2016

(65) Prior Publication Data

US 2017/0174412 A1 Jun. 22, 2017

Related U.S. Application Data

(60) Provisional application No. 62/269,023, filed on Dec. 17, 2015.

(51) Int. Cl.
*B65D 83/10* (2006.01)

(52) U.S. Cl.
CPC ..... *B65D 83/10* (2013.01)

(58) Field of Classification Search
CPC ..... B65D 83/10
USPC ..... 221/154, 279, 244
See application file for complete search history.

(56) References Cited

U.S. PATENT DOCUMENTS

| | | | | |
|---|---|---|---|---|
| 1,350,886 A | | 8/1920 | Scholz | |
| 1,654,554 A | | 1/1928 | Pasch | |
| 2,094,722 A | | 10/1937 | Sandford | |
| 2,272,444 A | | 2/1942 | Testi | |
| 2,295,464 A | | 9/1942 | Garbaty | |
| 2,303,764 A | | 12/1942 | Roberts | |
| 2,309,780 A | | 2/1943 | Muros | |
| 2,321,570 A | | 6/1943 | Billing | |
| 2,344,962 A | | 3/1944 | Benjamin | |
| 2,431,523 A | * | 11/1947 | Tuerff | B65D 83/10 221/198 |
| 2,439,243 A | | 4/1948 | Dalkowitz | |
| 2,458,020 A | | 1/1949 | Olsen | |
| D156,909 S | | 1/1950 | Nelson | |
| 2,522,896 A | | 9/1950 | Rifkin et al. | |
| 2,564,712 A | | 8/1951 | Muros et al. | |
| 2,624,453 A | | 1/1953 | Muros | |
| 2,637,900 A | | 5/1953 | Thompson | |
| 2,641,358 A | | 6/1953 | Santo | |
| 2,653,704 A | | 9/1953 | Nelson | |

(Continued)

FOREIGN PATENT DOCUMENTS

| | | |
|---|---|---|
| CA | 127032 S | 7/2009 |
| CA | 127039 S | 7/2009 |

(Continued)

OTHER PUBLICATIONS

International Search Report issued in PCT/US2014/064510, dated Jan. 30, 2015. Cited in U.S. Appl. No. 15/035,177.

(Continued)

*Primary Examiner* — Rakesh Kumar
(74) *Attorney, Agent, or Firm* — McGuireWoods LLP

(57) ABSTRACT

A blade dispenser is provided that includes a housing, a carrier, and a blade eject assembly. The housing defines a carrier cavity having an open end, and includes a blade loading mechanism. The carrier is operable to hold a plurality of blades. The carrier is selectively disposable within the carrier cavity of the housing. The blade eject assembly includes a button biased in a normal position relative to a base. The button is operable to be moved relative to the base and engage a blade disposed within the carrier, and to move the blade to a position where at least a part of the blade is disposed outside the housing.

18 Claims, 25 Drawing Sheets

(56) References Cited

U.S. PATENT DOCUMENTS 2,684,151 A 7/1954 Arrighi
2,685,364 A 8/1954 Treiss
D179,225 S 11/1956 Smith
2,792,933 A 5/1957 Butlin
2,829,764 A 4/1958 Silverman
2,889,076 A 6/1959 Van Schie
D187,224 S 2/1960 Jakeway
D187,389 S 3/1960 Becker
D187,562 S 3/1960 Zierhut
2,946,482 A 7/1960 Johnson
2,971,676 A 2/1961 Honcharenko
3,037,664 A 6/1962 Kuhnl
3,040,929 A 6/1962 Tapper
3,070,260 A 12/1962 Smith
3,080,998 A 3/1963 La Cas
3,093,266 A 6/1963 Kuhnl
3,115,991 A 12/1963 Carew et al.
3,373,862 A 3/1968 Minchin
3,460,712 A 8/1969 Lowry
3,542,245 A 11/1970 Braginetz
3,543,918 A 12/1970 Borden et al.
3,549,046 A 12/1970 Iten
3,563,412 A 2/1971 James
3,612,348 A 10/1971 Thomas
3,667,122 A 6/1972 Black
D227,753 S 7/1973 Muncy
3,767,083 A 10/1973 Webb
D231,202 S 4/1974 Stratford et al.
D231,670 S 5/1974 Haworth et al.
3,827,597 A 8/1974 Braginetz
3,850,343 A 11/1974 Petrillo
3,869,066 A 3/1975 Ferraro
D235,135 S 5/1975 Poisson
D240,116 S 6/1976 Poisson
D240,902 S 8/1976 Byrne
4,114,780 A 9/1978 Sharon
4,151,931 A 5/1979 Scherer et al.
D252,558 S 8/1979 Beck
D252,853 S 9/1979 Perkins
4,207,790 A 6/1980 Endo
D260,054 S 8/1981 Morgan
D260,489 S 9/1981 Pritchard
4,316,554 A 2/1982 Lloyd
4,379,514 A 4/1983 Joffe
4,430,012 A 2/1984 Kooy et al.
4,730,376 A 3/1988 Yamada
4,789,080 A 12/1988 Iten
4,792,058 A 12/1988 Parker
D299,288 S 1/1989 Stafford
4,826,042 A 5/1989 Vujovich
4,850,512 A 7/1989 Vujovich
D303,082 S 8/1989 Iten
4,852,379 A 8/1989 Levenberg
D307,670 S 5/1990 Nava
D317,985 S 7/1991 Alm
5,139,167 A 8/1992 McCarthy
5,148,916 A 9/1992 Tillyer, Sr.
5,251,783 A 10/1993 Gringer
D341,568 S 11/1993 Sorenson et al.
5,305,913 A 4/1994 Shade
D390,103 S 2/1998 Gerson
D392,157 S 3/1998 Shibuya
D403,954 S 1/1999 Okada et al.
D407,972 S 4/1999 Hilton
6,082,581 A 7/2000 Anderson et al.
6,102,098 A 8/2000 Randazzo
D432,911 S 10/2000 Clarke et al.
D433,940 S 11/2000 Lindsay et al.
6,158,616 A 12/2000 Huang
6,382,460 B1 5/2002 Gonzalez
6,508,380 B1 * 1/2003 von Schuckmann ..... B65D 83/0835 221/155
D474,402 S 5/2003 Baerenwald
6,598,761 B1 7/2003 Chou
6,763,972 B2 7/2004 Graupner
6,796,455 B2 9/2004 Schmidt
D519,469 S 4/2006 Sorenson
D522,855 S 6/2006 Liebe et al.
D527,995 S 9/2006 Tanner
7,140,650 B2 11/2006 Berg
D536,624 S 2/2007 Novak et al.
D540,539 S 4/2007 Gutierrez
D546,671 S 7/2007 Cronin et al.
D550,632 S 9/2007 Samuels et al.
D554,468 S 11/2007 Ahlgren
D555,512 S 11/2007 Lam
D561,047 S 2/2008 Shields
D595,152 S 6/2009 Van Deursen
D596,046 S 7/2009 Van Deursen
7,641,072 B1 1/2010 Vlastakis et al.
D613,147 S 4/2010 Ito
D624,833 S 10/2010 Van Deursen
D650,986 S 12/2011 Brady et al.
D702,649 S 4/2014 Ichio
8,809,726 B2 * 8/2014 Nakajima ..... B23K 11/3072 219/86.25
D720,628 S 1/2015 Erdmann
D727,272 S 4/2015 Johnson
9,039,977 B2 * 5/2015 Chan ..... B65D 83/0829 422/547
D742,760 S 11/2015 Garavaglia et al.
9,248,949 B2 * 2/2016 Leifeld ..... A61J 7/0481
9,505,544 B2 * 11/2016 Leifeld ..... A61J 7/0076
9,522,774 B2 * 12/2016 Gringer ..... B65D 83/10
D779,338 S 2/2017 Wonderley
2002/0162849 A1 11/2002 Chen
2003/0146236 A1 8/2003 Chou
2004/0099682 A1 5/2004 Huang
2004/0178214 A1 9/2004 Wei
2004/0178216 A1 9/2004 Brickwood et al.
2004/0200080 A1 10/2004 Lauri
2005/0230411 A1 * 10/2005 Veo ..... F42B 39/02 221/185
2005/0281706 A1 12/2005 Funke et al.
2006/0049201 A1 3/2006 Lanz
2007/0034640 A1 2/2007 Casale
2007/0185449 A1 8/2007 Mernoe
2008/0217353 A1 9/2008 Newman et al.
2009/0194557 A1 * 8/2009 Van Deursen ..... B65D 83/10 221/232
2011/0042406 A1 * 2/2011 Nakajima ..... B23K 11/115 221/244
2011/0233229 A1 9/2011 Schekalla
2011/0315706 A1 12/2011 Lockwood et al.
2012/0006844 A1 1/2012 Kobayashi
2012/0024881 A1 2/2012 Papaloizou et al.
2013/0015198 A1 * 1/2013 Bollmus ..... A45C 11/20 221/150 R
2013/0126550 A1 5/2013 Schneider et al.
2013/0291955 A1 11/2013 Laible
2014/0034665 A1 2/2014 Walter
2014/0086796 A1 * 3/2014 Giraud ..... G01N 33/48757 422/68.1
2015/0114997 A1 4/2015 Uldry et al.
2016/0016778 A1 1/2016 Taylor
2016/0069859 A1 * 3/2016 Prais ..... G01N 33/48757 422/68.1
2016/0242765 A1 8/2016 George et al.
2016/0304269 A1 * 10/2016 Erdmann ..... B65D 83/0817
2017/0174412 A1 * 6/2017 Wonderley ..... B65D 83/10

FOREIGN PATENT DOCUMENTS

CA 127047 S 7/2009
CA 2713708 A1 8/2009
CN 200830138544 11/2009
CN 200830139300 1/2010
CN 200830211300 1/2010
CN 101970312 A 2/2011
DE 815829 C 10/1951
DE 4117356 A1 12/1992
EM 000977582-0001 7/2008

(56) References Cited

FOREIGN PATENT DOCUMENTS

| | | | | |
|---|---|---|---|---|
| EM | 000977590-0001 | | 7/2008 | |
| EM | 00977632-0001 | | 7/2008 | |
| EM | 002454512-0001 | | 4/2014 | |
| EP | 1731447 | A1 | 12/2006 | |
| EP | 2240388 | A1 | 10/2010 | |
| EP | 2301861 | A1 | 3/2011 | |
| EP | 3066031 | A1 | 9/2016 | |
| FR | 2460643 | A1 | 1/1981 | |
| FR | 2723725 | A1 | 2/1996 | |
| FR | 2772349 | A1 * | 6/1999 | ..... B65D 5/72 |
| GB | 2033344 | A | 5/1980 | |
| GB | 2504852 | A | 2/2014 | |
| HK | 1146538 | | 6/2011 | |
| JP | 200062869 | A | 2/2000 | |
| JP | D1112607 | S | 6/2001 | |
| JP | D1142823 | S | 6/2002 | |
| MX | 2010008445 | A | 1/2011 | |
| TW | 135653 | | 6/1990 | |
| TW | 462608 | | 11/2001 | |
| TW | D130181 | | 8/2009 | |
| TW | D130182 | | 8/2009 | |
| TW | D130397 | | 8/2009 | |
| WO | 2009097521 | A1 | 8/2009 | |
| WO | 2015069992 | A1 | 5/2015 | |

OTHER PUBLICATIONS

Taiwanese Search Report issued in Taiwanese Design Application No. 097304388 date of Research Mar. 30, 2009. English Translation provided. Cited in U.S. Appl. No. 29/290,910.

International Search Report issued in International Patent Application No. PCT/US2009/032631, dated Mar. 13, 2009 Cited in U.S. Appl. No. 12/362,752.

European Search Report issued in European Patent Application No. 09705689.9. Cited in U.S. Appl. No. 12/362,752.

Communication pursuant to Article 94(3) EPC dated Nov. 21, 2017, issued in related co-pending European Application No. 14806127.8.

Imedger retrieved from http://www.imedger.com/pages/framedger.html. Retrieved Feb. 5, 2008. Cited in U.S. Appl. No. 12/362,752.

Red Personna Precision 'Zipak' Dispenser and Razor Blades retrived from http://cgi.ebay.com/RED-PERSONNA-PRECISION-ZIPAK-DISPENSER-RAZOR-BLADES_W0QQitemZ110161800345QQihZ001QQcategoryZ35989QQrdZ1QQssPageNameZWD1VQQtrksidZp1638.m118.11247QQcmdZViewItem. Retrieved Feb. 11, 2008. Cited in U.S. Appl. No. 12/362,752.

Sectioning and Microtomy Supplies, retrieved from http://www.aname.es/microscopia/ems/histology/sectioning.html. Retrieved Feb. 5, 2008. Cited in U.S. Appl. No. 12/362,752.

http://packandseal.com/CuttersRazor.html, retrieved Feb. 11, 2008. Cited in U.S. Appl. No. 12/362,752.

http://www.tool-up.co.uk/shop/diy/STA028510.html, retrieved Feb. 11, 2008. Cited in U.S. Appl. No. 12/362,752.

http://www.artistcraft.com/Tools/Cups_Cutting_Caulking_Equip/193, retrieved Feb. 11, 2008. Cited in U.S. Appl. No. 12/362,752.

International Search Report issued in related co-pending PCT/US2016/67000 dated Mar. 31, 2017.

Office Action issued in related European Patent Application No. 14 806 127 dated Jun. 9, 2017.

* cited by examiner

SECTION A-A

SECTION B-B

BLADE DISPENSER

BACKGROUND

Technical Field

The present invention relates to blade dispensers in general, and to blade dispensers for safely handling blades in particular.

Background Information

Blade dispensers are used to conveniently store and dispense a number of blades, such as standard, single-edge razor blades. Some of these blades have one sharp blade edge at the bottom, and an opposed, safe top edge with a folded-over protective cap that can be metal. These blades are typically used for scraping and cutting. Conventional blade dispensers require the user to catch a small protruding portion of the blade with the edge of a finger or fingernail, and push the blade slightly out through a slot in the front of the dispenser. Typically, at this point the blade to be dispensed is slightly extended sideways from the dispenser, exposing both a portion of the safe top edge and the sharp blade edge. The blade is then grasped with the thumb and forefinger and removed from the dispenser. One disadvantage of conventional dispensers is that many users find it difficult to catch a small portion of the blade with their finger or fingernail, which may be injured in the attempt to catch the blade portion. Moreover, exposure of a portion of the sharp blade edge during the dispensing process exposes the user's fingers to injury. There exists a need for a blade dispenser that dispenses blades easily and safely

SUMMARY

In an embodiment, a blade dispenser is provided that includes a housing defining a carrier cavity having an open end. The housing includes a blade loading mechanism; wherein the blade loading mechanism includes a sled, a flexible member, a pivotable member, and a biasing element. The sled comprises a cam.

The blade dispenser further includes a carrier. The carrier is operable to hold a plurality of blades and which carrier is selectively disposable within the carrier cavity of the housing. The carrier comprises a dog capable of being selectively positioned at lengthwise positions within the carrier. The cam is capable of contacting a follower latch disposed on the dog.

The blade dispenser further includes a blade eject assembly having a button biased in a normal position relative to a base. The button is operable to be moved relative to the base and engage a blade disposed within the carrier and move the blade to a position where at least a part of the blade may be accessible from an exterior of the housing.

Additionally or alternatively, the present blade dispenser may include one or more of the following features individually or in combination:

a) The contact of the cam and the follower latch may induce the follower latch to be moved away from the position it had prior to the contact with the cam.

b) The housing may further comprise a row of teeth positioned lengthwise along the bottom of the carrier cavity. The row of teeth may be configured to engage a pawl disposed on the follower latch.

c) The sled may be capable of being biased against the dog such that a ramped portion of the cam contacts the follower latch of the dog. The contact of the ramped portion of the cam with the follower latch may induce the disengagement of the pawl with the row of teeth.

d) The housing may further comprise a first carrier button disposed on a first side of the housing, and a second carrier button disposed on a second side of the housing, each of which carrier buttons is operable to engage the carrier disposed within the carrier cavity to selectively secure the carrier within the carrier cavity.

e) The blade eject assembly may be selectively positionable relative to the housing in an open position and in a closed position.

f) The blade eject assembly may be pivotally mounted to the housing, and the housing may include at least one blade eject assembly latch button, which button is operable to secure the blade eject assembly relative to the housing.

g) The carrier may include one or more panels that define a blade cavity sized to contain a plurality of blades. The blade cavity may have a cross-sectional geometry that accommodates the blades held within the carrier.

h) The one or more panels may include a top panel and a front panel configured to receive a portion of the blade eject assembly button. The top panel may engage the front panel and wherein such engagement produces a slot between the top panel and the front panel. The front panel may comprise ribs disposed on the interior of the front panel such that the ribs control the size and shape of the slot when engaged with the top panel.

i) The housing may have a floor panel that includes a carrier surface and a bottom surface. The bottom surface may be disposed opposite the carrier surface. The floor panel may include a lengthwise extending slot, which slot extends through the floor panel between the carrier surface and the bottom surface. The sled may be configured for travel along the lengthwise extending slot disposed in the floor panel.

j) The sled may include a slot member extending between a bottom surface flange and a blade flange. The slot member may be received within the lengthwise extending slot disposed in the housing floor panel. The bottom surface flange may be disposed adjacent the bottom surface of the housing floor panel. The blade flange may be disposed adjacent the carrier surface of the housing floor panel. The cam may be disposed extending outwardly from the blade flange. The flexible member may be attached to the bottom surface flange of the sled, and extends around at least a portion of the pivotable member. The biasing element may be operable to bias the sled toward the open end of the carrier cavity of the housing.

k) The pivotable member may comprise at least two sides. The pivotable member may further comprise a biasing element coupled to the pivotable member on each of the two sides.

l) The carrier may be a unitary structure that includes a plurality of panels and each panel is connected to another panel by a hinge. The panels may be configured to assemble and define a blade cavity sized to contain a plurality of blades, which blade cavity has a cross-sectional geometry that accommodates the blades held within the carrier.

m) The housing may further comprise a cap and a base. The cap and the base may at least partially define the carrier cavity. The base may comprise posts. The cap may comprise holes. The posts may be capable of engaging the holes to align the cap with the base.

n) The blade eject assembly may include a blade engagement structure attached to the blade eject assembly button.

The blade engagement structure may be configured to engage one of the plurality of blades which the carrier is operable to hold.

o) The blade engagement structure may extend outwardly from the blade eject assembly button and include a widthwise extending member having a length substantially equal to a width of the plurality of blades which the carrier is operable to hold.

p) The widthwise extending member may include a slot disposed in a top surface of the member.

q) The blade dispenser may further comprise a selectively removable insert having at least one contactor, wherein the insert is attached to the blade engagement structure and the contactor extends outwardly from the slot.

r) The sled may comprise a blade flange and a cam. The cam may comprise a contact surface having a ramped portion at a joinder portion. The ramped portion may be angled toward the flexible member. The cam may further comprise a web member coupled to the blade flange and the joinder portion.

s) The carrier may comprise a row of teeth disposed lengthwise along an interior of the carrier. The carrier may further comprise a dog capable of being selectively positioned at lengthwise positions within the carrier. The dog may comprise a follower latch. The follower latch may comprise a pawl. The follower latch may be angled on the dog such that the pawl of the follower latch is engaged with the row of teeth.

t) The row of teeth may comprise a feed pitch greater than the thickness of one blade.

u) The overlap of the length of the tip of the pawl and the length of the tip of a tooth within the row of teeth may be less than the thickness of one blade.

v) The row of teeth may comprise a feed pitch greater than the thickness of one blade, and the overlap of the length of the tip of the pawl and the length of the tip of a tooth within the row of teeth may be less than the thickness of one blade. The present disclosure and advantages associated therewith will become more readily apparent in view of the detailed description provided below, including the accompanying drawings.

DETAILED DESCRIPTION

Figure 1:
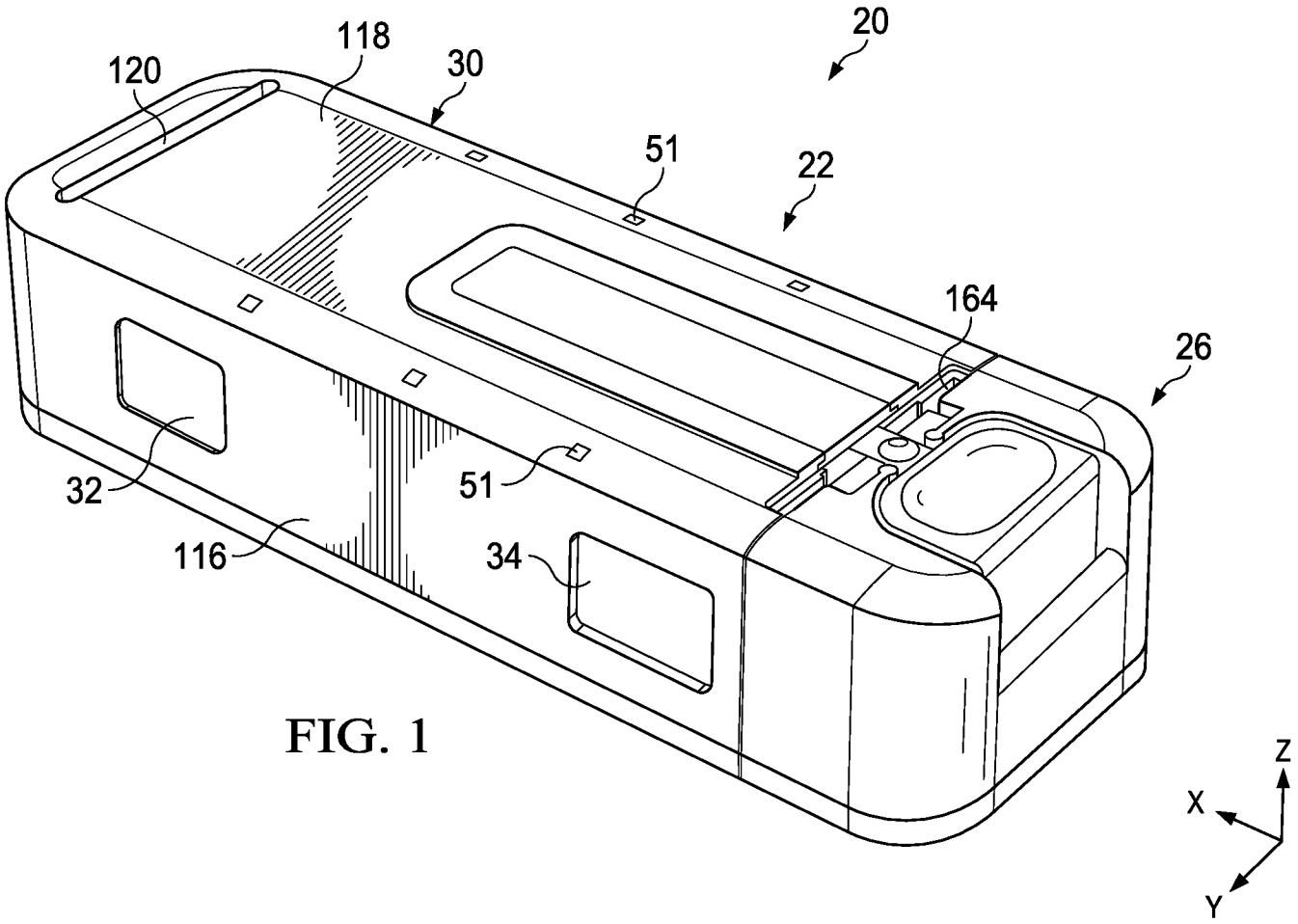
FIG. 1 is a isometric view of a blade dispenser embodiment, illustrating the blade eject assembly in a closed position.
Figure 2:
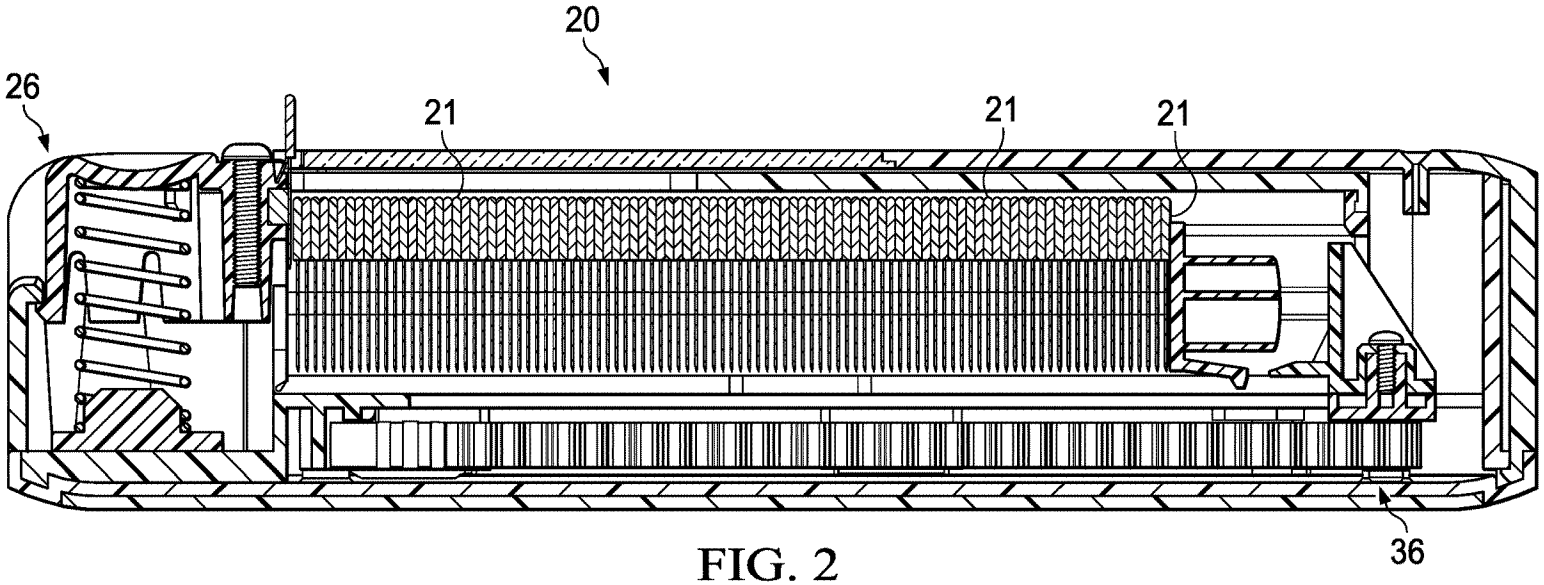
FIG. 2 is a cross-sectional view of the blade dispenser.
Figure 3:
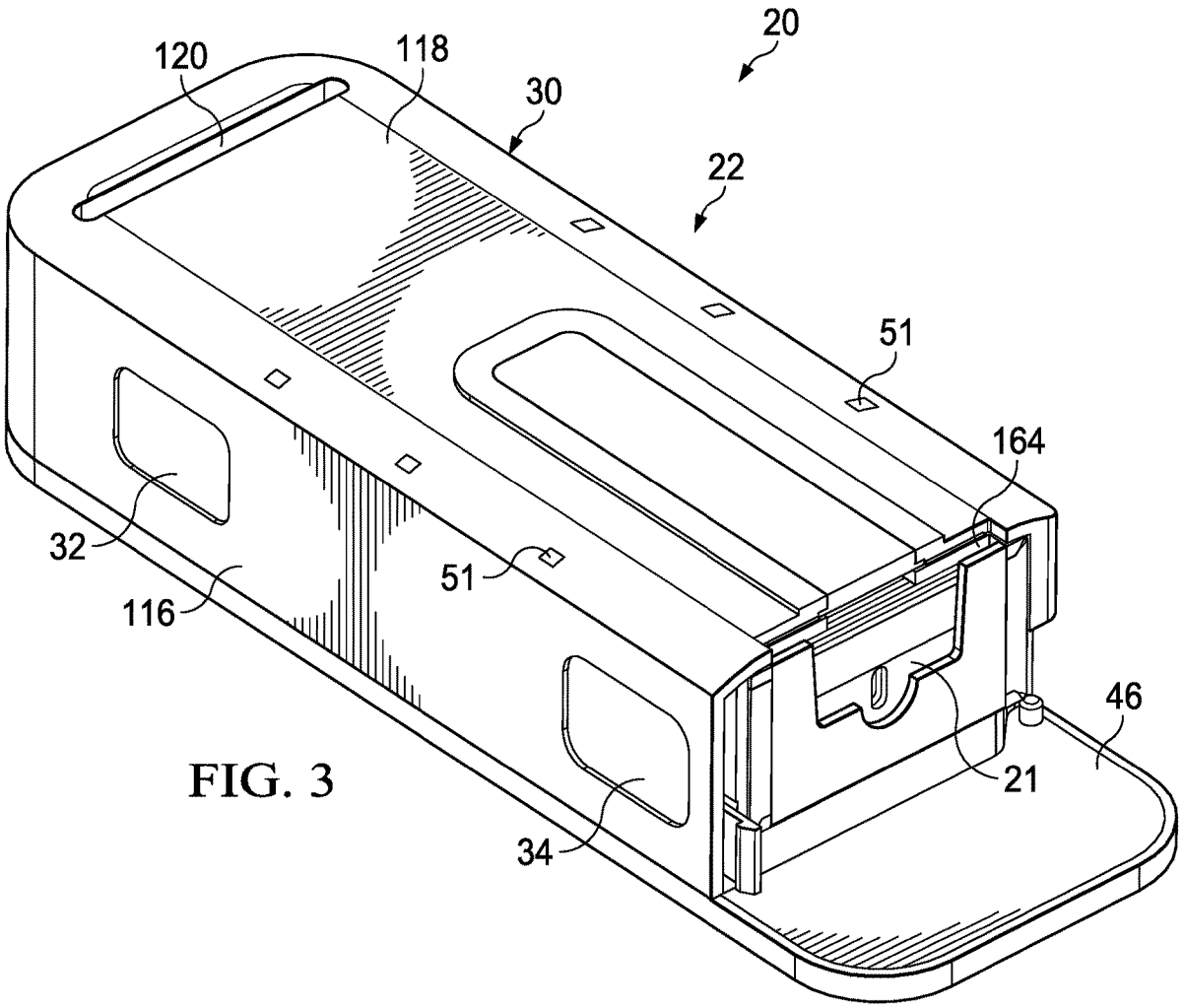
FIG. 3 is an isometric view of the blade dispenser with the blade eject assembly removed.

Referring to FIGS. 1-3, a blade dispenser 20 (for dispensing individual blades 21) is provided that includes a housing 22, a blade carrier 24 (shown on FIG. 10) disposed within the housing 22, and a blade eject assembly 26. The housing 22 includes a base 28 (shown on FIG. 4), a cap 30, at least one carrier button 32, a blade eject assembly latch button 34, and a blade loading mechanism 36.

Figure 4:
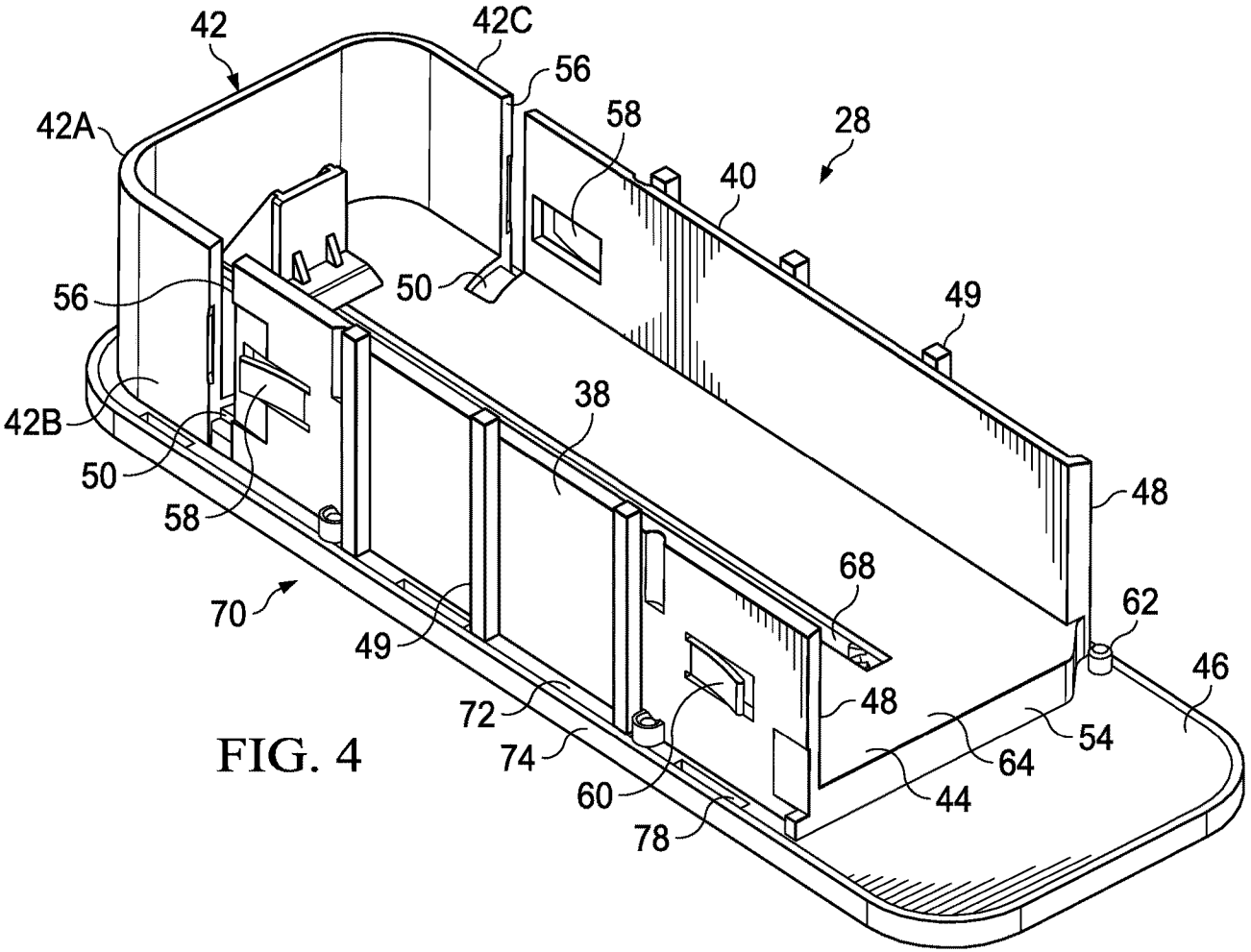
FIG. 4 is an isometric view of the housing base.

Now referring to FIG. 4, the base 28 includes a first side wall panel 38, a second side wall panel 40, an end wall panel 42, a floor panel 44, and a front flange 46. Each side wall panel 38, 40 extends lengthwise between an opening edge 48 and an interior edge 50. As used herein, the terms "lengthwise", "widthwise", and "heightwise" refer to, respectively, directions along the x-axis, y-axis, and z-axis; e.g., see orthogonal axes disposed adjacent FIG. 1. The interior edges 50 of each side wall panel 38, 40 are disposed proximate the end wall panel 42. The side wall panels 38, 40 and the end wall panel 42 extend outwardly from the floor panel 44, and define a slot-shaped carrier cavity 52 with an open end 54. In the embodiment shown in FIG. 4, each side wall panel 38, 40 is configured as a single panel that extends lengthwise substantially the length of the floor panel 44, and the end wall panel 42 includes a widthwise extending portion 42A, and two lengthwise extending portions 42B, 42C. In this configuration the end wall panel 42 extends substantially between the interior edges 50 of the side wall panels 38, 40, separated from the interior edges 50 on each side by a slot 56. The housing base 28 is not limited to this particular embodiment and may include other configurations that define the slot-shaped carrier cavity 52. For example, each side wall panel 38, 40 may include a plurality of wall sections generally coplanar with one another, and the end wall panel 42 may extend less than substantially between the side wall panels 38, 40, or may not be included at all.

The side wall panels 38 and 40 each include a plurality of posts 49 proximate the side wall panels 38 and 40 and which outwardly extend heightwise along the exterior of the side wall panels 38 and 40 away from the floor panel 44. The posts 49 extend beyond the height of side walls 38 and 40 such that the uppermost portion of the posts 49 (i.e., the portion furthest from the floor panel 44) is no longer proximate the side wall panels 38 and 40 as can be seen in FIG. 4. This uppermost portion of the posts 49 may be used to engage corresponding holes 51 (visible in FIG. 3) disposed lengthwise along the outermost lateral portions of the top panel 118 of cap 30 as will be explained below. FIG. 4 illustrates six posts 49, but any number of posts may be used as desired. Posts 49 may be placed at any desired distance from each other. In some embodiments, posts 49 may be affixed to side wall panels 38 and 40. In alternative embodiments, posts 49 and side walls 38 and/or 40 may comprise one continuous piece.

The first side wall panel 38 includes a carrier button biasing mechanism 58 and a blade eject assembly latch button biasing mechanism 60, and the second side wall panel 40 includes a carrier button biasing mechanism 58. In the embodiment shown in FIG. 4, the carrier button biasing mechanisms 58 and the blade eject assembly latch button biasing mechanism 60 are shown as outwardly extending cantilever tabs that are engaged by buttons as will be described below. The carrier button biasing mechanisms 58 and the blade eject assembly latch button biasing mechanism 60 are not limited to a cantilever embodiment. In addition, one or more than two carrier button biasing mechanisms 58 may be used; e.g., if one or more carrier buttons 32 are used as will be described below.

The front flange 46 extends outwardly from the floor panel 44, proximate the open end 54 of the carrier cavity 52. A blade eject assembly pivot post 62 is fixed to the front flange 46, adjacent the opening edge 48 of the second side wall panel 40.

The floor panel 44 includes a carrier surface 64 and a bottom surface 66 (see FIG. 7), which bottom surface 66 is disposed opposite the carrier surface 64. A slot 68 extends through the floor panel 44 between the carrier surface 64 and the bottom surface 66. The slot 68 has a width and a length. In some embodiments, a cap ledge 70 extends around the outer periphery of the floor panel 44, including a first portion 72 that extends away from the wall panels 38, 40, and a second portion 74 that extends away from the floor panel bottom surface 66. The second portion 74 of the cap ledge 70 and the floor panel bottom surface 66 define a mechanism cavity 76 there between. A plurality of slots 78 is disposed in the first portion of the cap ledge 70. The slots 78 are configured to receive tabs extending out from the cap 30 as will be explained below.

Figure 5A:
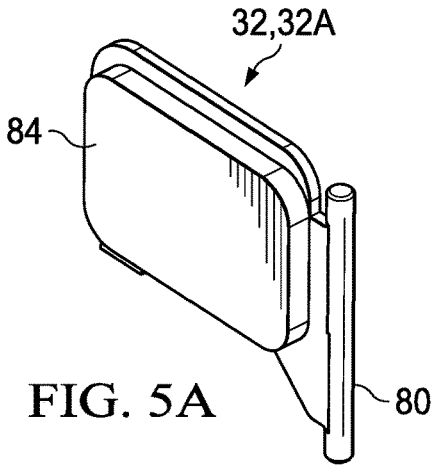
FIGS. 5A and 5B are isometric views of the carrier buttons.
Figure 5B:
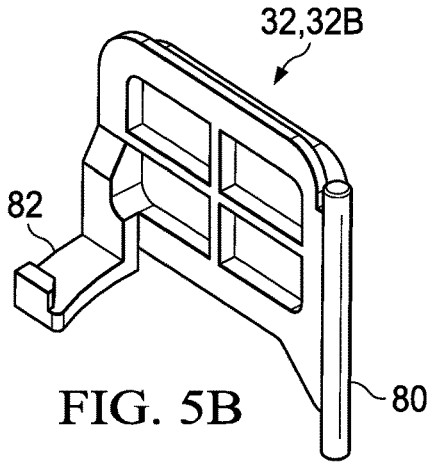
Figure 10:
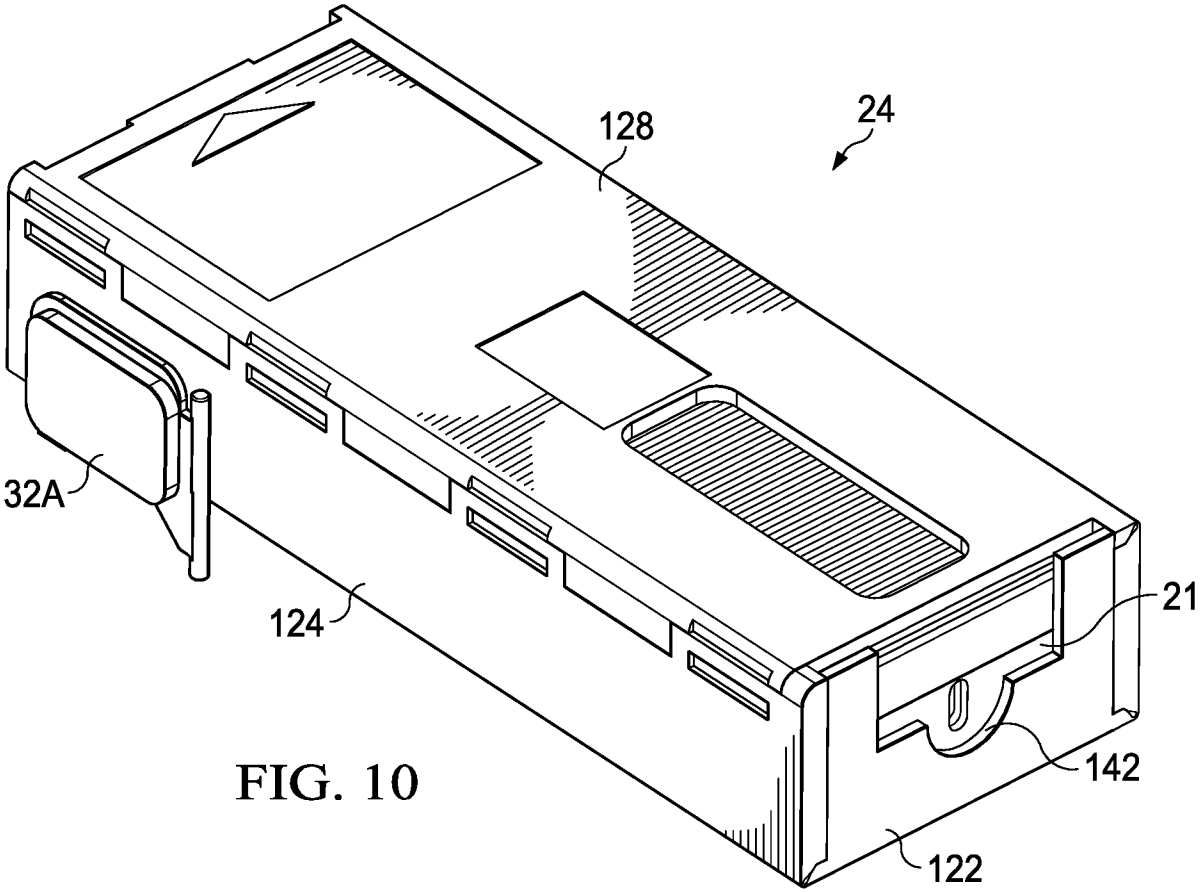
FIG. 10 is an isometric view of the carrier with the carrier buttons positioned aside.
Figure 11:
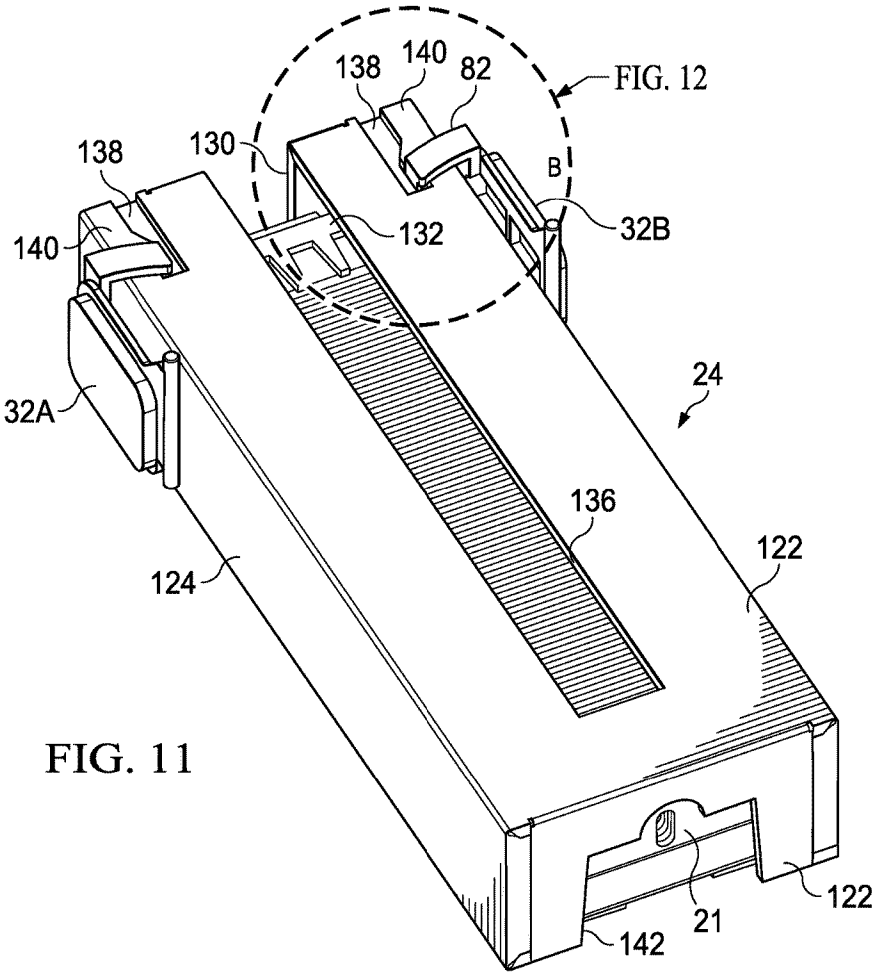
FIG. 11 is an isometric bottom view of the carrier with the carrier buttons positioned aside.
Figure 12:
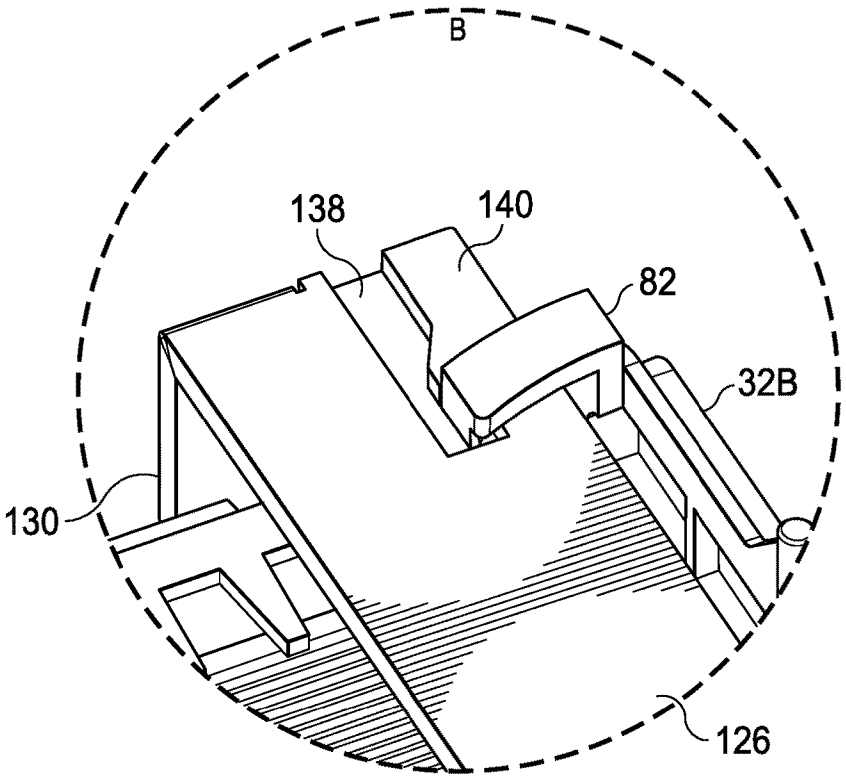
FIG. 12 is an enlarged isometric view of a carrier button engaged with the carrier taken at Detail B of FIG. 11.
Figure 13:
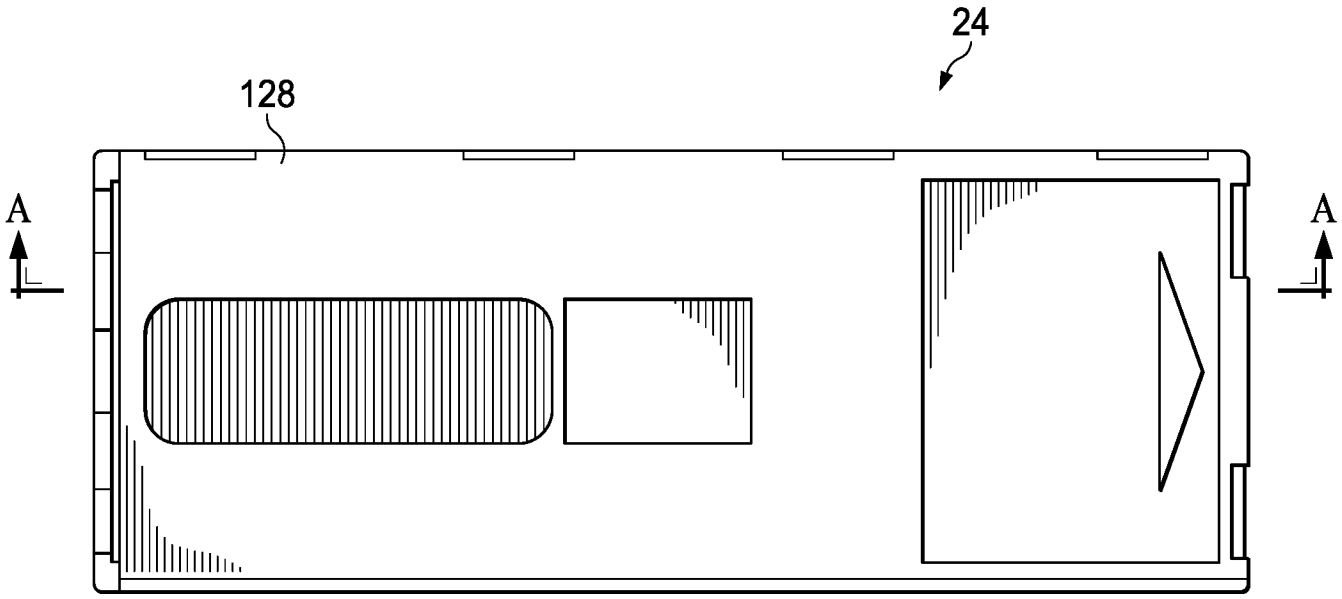
FIG. 13 is an isometric view of the top of the carrier.
Figure 14A:
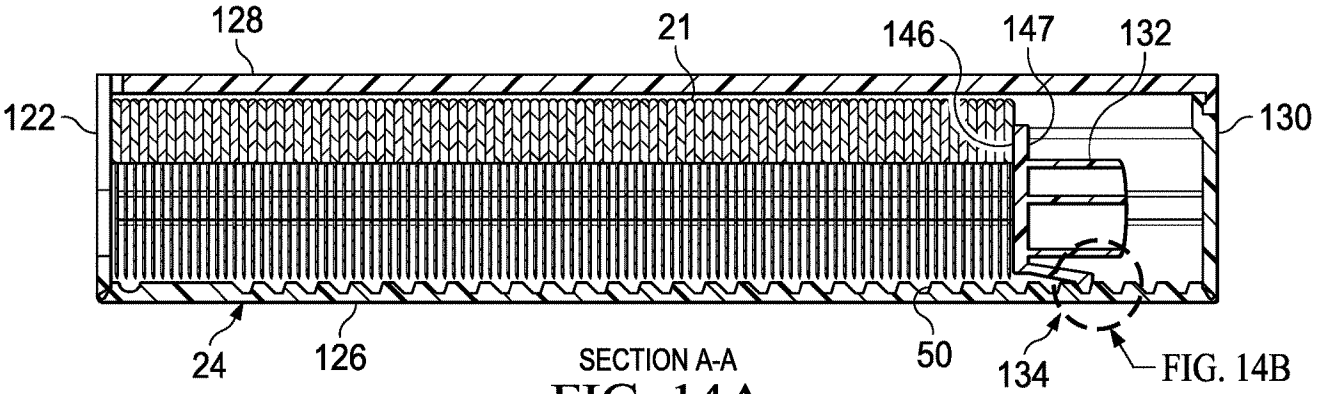
FIG. 14A is a cross-sectional view of the carrier along line A-A.
Figure 14B:
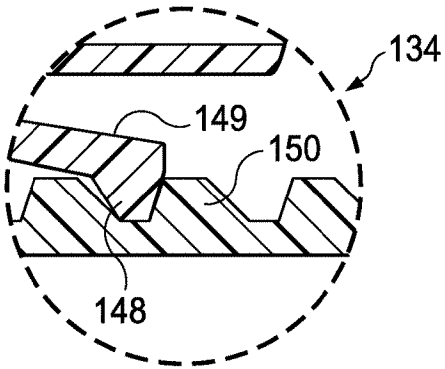
FIG. 14B is an enlarged isometric view of the detent mechanism of FIG. 14A.

Now referring to FIGS. 5A and 5B, in those embodiments that use a pair of carrier buttons 32 (e.g., as shown in FIGS. 10 and 11), the pair includes a first carrier button 32A and a second carrier button 32B that are mirror versions (i.e., left and right hand) of the same structure. Since the buttons 32A, 32B share the same features (albeit left and right hand configurations), only one button is described hereinafter. The button 32 includes a pivot axle 80, a latch 82, and a contact surface 84 disposed between a first end and a second end. The pivot axle 80 is disposed proximate the first end of the button 32 and the latch 82 extends outwardly from the second end of the button 32. The latch 82 is configured to engage the carrier 24 as will be described below. The first carrier button 32A is pivotally mounted to the cap ledge 70 adjacent the first side wall panel 38 (see FIGS. 10 and 11), and the second carrier button 32B is pivotally mounted to the cap ledge 70 adjacent the second side wall panel 40. The present blade dispenser 20 is not limited to this particular carrier button 32 embodiment. In addition as indicated above, one or more than two carrier buttons 32 may be used.

Figure 6:
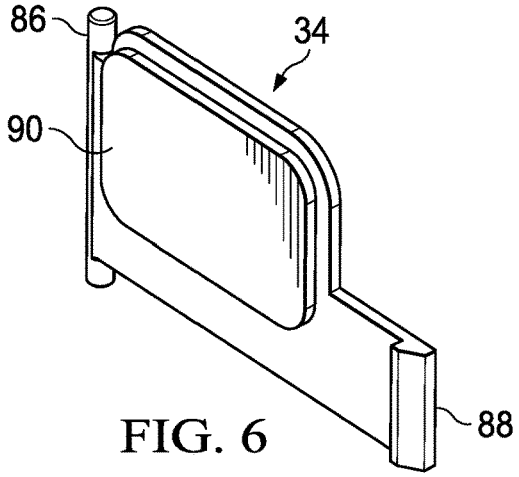
FIG. 6 is a isometric view of the blade eject assembly latch button.

Now referring to FIG. 6, the blade eject assembly latch button 34 includes a pivot axle 86, a latch 88, and a contact surface 90 disposed between a first end and a second end. The pivot axle 86 is disposed proximate the first end of the button 34 and the latch 88 extends outwardly from the second end of the button 34. The latch 88 is configured to engage the blade eject assembly 26 as will be described below. The blade eject assembly latch button 34 is pivotally mounted to the cap ledge 70 adjacent the first side wall panel 38.

Figure 7:
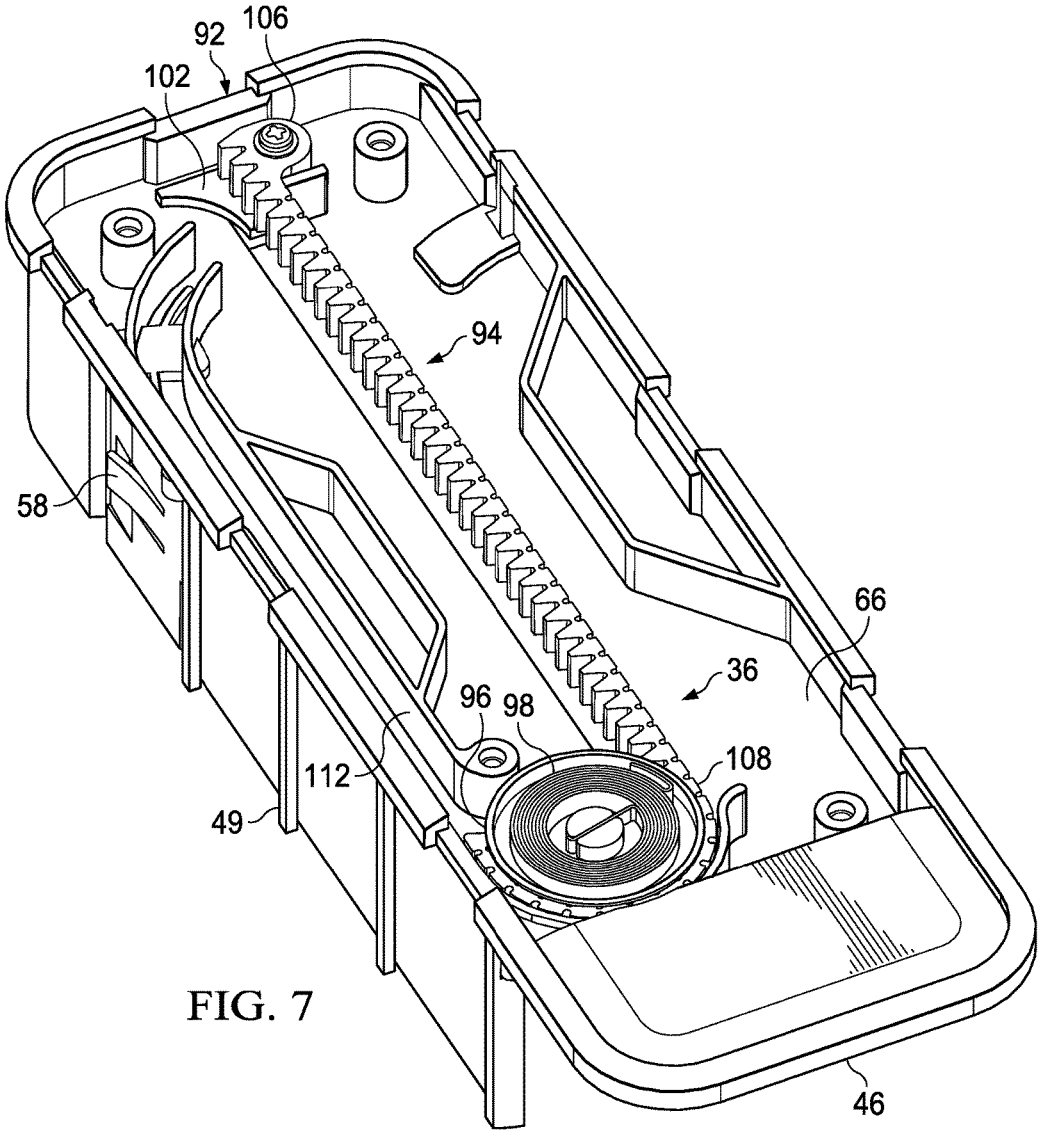
FIG. 7 is a isometric bottom view of the blade dispenser, illustrating aspects of the blade loading mechanism.
Figure 8:
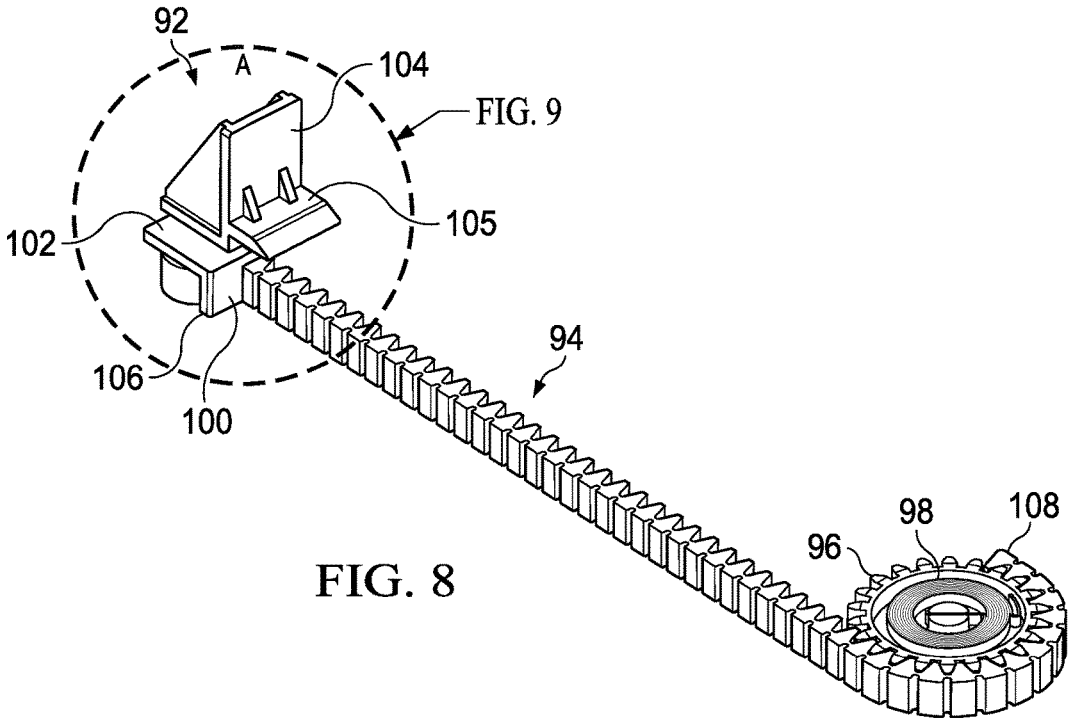
FIG. 8 is an isometric view of elements of the blade loading mechanism.
Figure 9:
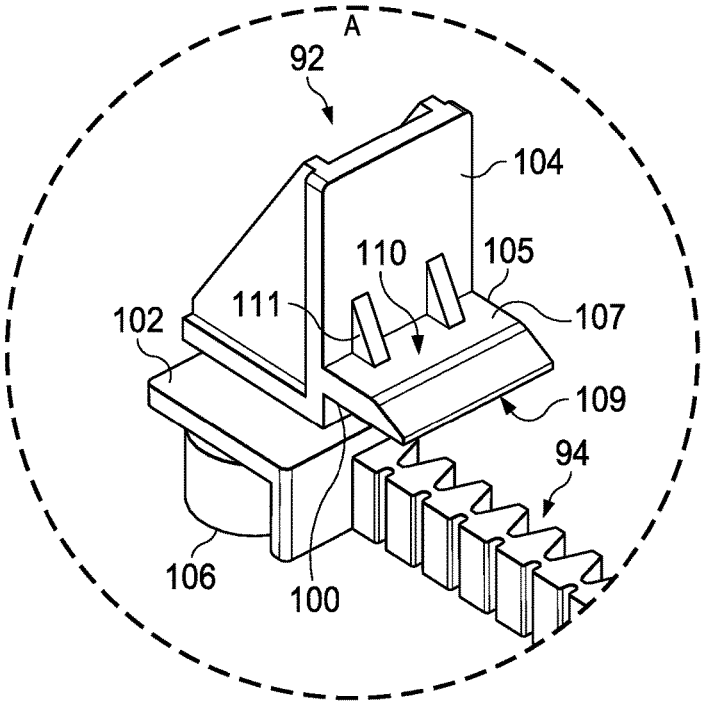
FIG. 9 is an enlarged isometric view of the blade loading mechanism sled taken at Detail A of FIG. 8.

Now referring to FIGS. 7, 8, and 9, the blade loading mechanism 36 includes a sled 92, a flexible member 94, a pivotable member 96 (e.g., a gear, etc.), and at least one biasing element 98. The sled 92 includes a slot member 100 extending between a bottom surface flange 102 and a blade flange 104. The slot member 100 has a width that is less than the width of the floor panel slot 68. The blade flange 104 and the bottom surface flange 102 each have a width that is greater that the width of the floor panel slot 68. The relative widths allow the sled slot member 100 to be received within the floor panel slot 68 and to slidably travel lengthwise within the floor panel slot 68, and the widths of the blade flange 104 and the bottom surface flange 102 prevent the sled 92 from passing through the floor panel 44. The blade flange 104 comprises a cam 105 which extends outwardly from the blade flange 104 to form a generally L-shaped profile with the blade flange 104. The cam 105 includes a contact surface 107 having a ramped portion 109 at a joinder portion 110. In an embodiment, the joinder portion 110 of the contact surface 107 may be substantially planar and/or substantially perpendicular to an adjoining surface of the blade flange 104. One or more web members 111 may be coupled to or integrally attached to the blade flange 104 and joinder portion 110 to provide structural rigidity between the components. The ramped portion 109 of the contact surface 107 is angled in a direction toward the flexible member 94 such that when the sled 92 is induced towards the carrier 24 the cam 105 is enabled to engage a dog 132 (shown on FIG. 26). The engagement between the cam 105 and the dog 132 induces the disengagement of a detent mechanism 134 (shown on FIG. 26) used to secure the dog 132 within the carrier 24 such that the dog 132 is unable to move backwards within the carrier 24.

The flexible member 94 has a first end 106 and a second end 108. The flexible member 94 may be in the form of a linked element construction (e.g., the linked teeth construction shown in FIGS. 7 and 8, a chain type structure, etc.) or a uniform cross-section profile configuration (e.g., a cable, a wire, a cord, a string, etc.) or other type flexible member, or combinations thereof. The pivotable member 96, is mounted to the floor panel bottom surface 66 for pivotable movement around a pivot axis. The pivotable member 96 is configured to retain the flexible member 94 around at least a portion of the pivotable member 96. For example, in those embodiments where the flexible member 94 has a linked element construction (e.g., the teeth shown in FIGS. 7 and 8), the pivotable member 96 may include teeth (e.g., a sprocket) that mesh with the linked element construction. In some embodiments, the blade loading mechanism 36 may include a chute 112 attached to the bottom surface of the floor panel 44 configured to receive the flexible member 94.

The blade loading mechanism 36 is arranged such that the first end 106 of the flexible member 94 is attached to the bottom surface flange 102 of the sled 92, and extends lengthwise to and around the pivotable member 96, engaging the teeth of the pivotable member 96. In those embodiments that include a chute 112, the flexible member 94 is either aligned to enter into the chute 112 or is at least partially disposed within the chute 112. The amount of the flexible member 94 that is disposed in the chute 112 depends on the lengthwise position of the sled 92.

The blade loading mechanism biasing member 98 is operable to bias the sled 92 toward the open end 54 of the carrier cavity 52. For example, in the embodiment shown in FIG. 8, the biasing member 98 comprises a torsion spring engaged with the pivotable member 96 on one side of the pivotable member 96 and operable to cause the pivotable member 96 to rotate about its pivot axis. A second biasing member 98 (e.g., a second torsion spring) may be engaged with the pivotable member 96 on the other side of pivotable member 96 (relative to the location of the first pivotable member 98) to provide additional force to cause the pivotable member 96 to rotate about its pivot axis in conjunction with the force exerted by the first biasing member 96. In an additional embodiment, an additional biasing member 98 may be attached to the second end 108 of the flexible member 94 to bias the sled 92 (attached to the opposite end of the flexible member 94) toward the open end 54 of the carrier cavity 52. The blade loading mechanism 36 is not limited to these embodiments, however.

Now referring to FIGS. 1-3, the cap 30 includes one or more side panels 116 and a top panel 118, and structure for attaching the cap 30 to the base 28. The side panels 116 and top panel 118 collectively enclose the carrier cavity 52, except for the open end 54 of the carrier cavity 52 which is not enclosed. The top panel 118 may include a window to permit visual inspection of the blades 21 disposed within the carrier 24 when the carrier 24 is disposed within the carrier cavity 52 as will be described below. The top panel 118 includes holes disposed lengthwise along the outermost lateral portions of the top panel 118 of cap 30 as described above. The holes 51 align with posts 49 of side panels 38 and 40 which are illustrated on FIG. 4. The holes 51 may be any size and shape sufficient for insertion of the uppermost portion of posts 49 such that once engaged the inserted uppermost portion of posts 49 aligns and secures the cap 30 with the side panels 38 and 40 of base 28 as desired. The structure for attaching the cap 30 to the base 28 includes a plurality of tabs (not shown) configured to engage the slots 78 disposed in the cap ledge 70. The cap 30 may alternatively be attached to the base 28 by other structure.

In some embodiments, the housing 22 may include a slot 120 (see FIGS. 1-3) for placing used blades 21 for safe storage and eventual disposal or to safely hold a blade that is in use.

Now referring to FIGS. 10-14B, the carrier 24 includes a front panel 122, a pair of side panels 124, a base panel 126, a top panel 128, a back panel 130, a position adjustable dog 132, and a detent mechanism 134 operable to positionally secure the dog 132. The base panel 126 includes a lengthwise extending slot 136 having a width that is greater than the width of the sled 92 to permit the sled 92 to pass through base panel slot 136. In the embodiment shown in FIGS. 11 and 12, the base panel 126 further includes a pair of latch slots 138 which (as will be described below) are configured to engage the respective carrier button latch 82. The latch slots 138 each include a ramped tooth 140 extending into the respective slot 138. The carrier 24 is not limited to the described latch slots 138 disposed in the base panel 126. For example, a latch slot 138 may be disposed in a side panel 124, top panel 128, or base panel 126, and the latch slot 138 may assume alternative configurations operable to engage a carrier button latch 82. The front panel 122 is configured to receive structure extending out from the blade eject assembly 26 as will be described below; e.g., the carrier front panel 122 shown in FIGS. 10 and 11 includes a U-shaped opening 142. The side panels 124, base panel 126, and top panel 128 extend lengthwise between the front panel 122 and the back panel 130 and define a blade cavity 144 there between. The cross-sectional geometry of the blade cavity 144 is selected to accommodate the blades 21 stored within the carrier 24; e.g., the carrier 24 shown in FIGS. 10, 11, and 13 has a rectangular cross-section blade cavity 144 which accommodates the rectangular shape of the blades 21. The carrier 24 is not limited to a rectangular cross-section configuration. The top panel 128 is selectively removable to permit blades 21 to be loaded into the blade cavity 144. The top panel 128 may include a window to permit visual inspection of the blades 21 disposed within the carrier 24. The top panel 128 is configured to include a cutout 141 disposed at the forward end of the top panel 128. The cutout 141 and the front panel 122 combine to form a slot. The slot is configured to allow the passage a razor blade there through.

The dog 132, which is disposed and adjustably positioned in the blade cavity 144, includes a blade contact face 146 (also shown in FIG. 25A) that extends widthwise between the side panels 124, a front flange 147 (also shown in FIG. 25B) that extends widthwise between the side panels 124, and a follower latch 149 which extends outwardly away from the front flange 147 in a direction towards the back panel 130 of the carrier 24. The follower latch 149 comprises a pair of pawls 148 (the pair is shown in FIG. 25B) affixed to the follower latch 149 and extending outwardly away from the follower latch 149 in a direction towards mating rows of teeth 150 disposed on the interior of the base panel 126 of the carrier 24. The follower latch 149 may extend away from the front flange 147 at an angle sufficient for the pawls 148 to engage the mating rows of teeth 150. Although two pawls 148 mated to two rows of teeth 150 are described, more or less pawls 148 and rows of teeth 150 may be provided as desired. The pawls 148 form the first portion of the detent mechanism 134 that is operable to positionally secure the dog 132. The pawls 148 are positioned to engage the mating rows of teeth 150 disposed on the interior of the base panel 126 of the carrier 24 such that when the pawls 148 are engaged with the mating rows of teeth 150, backwards movement of the dog 132 towards the back panel 130 is resisted. The mating rows of teeth 150 form the second portion of the detent mechanism 134. As will be described in detail below, the detent mechanism 134 may position and/or secure the dog 132 such that the dog 132 is able to be moved towards the front panel 122 to engage and secure a plurality of blades 21, but movement of the dog 132 towards the back panel 130 and away from the plurality of blades 21 is resisted. The detent mechanism 134 is not limited to the described embodiment. For example, in alternative embodiments, there may be one or more than two pawls 148, one or more than two rows of teeth 150, or the pawls 148 and rows of teeth 150 may be positioned alternatively in the carrier 24.

Figure 15:
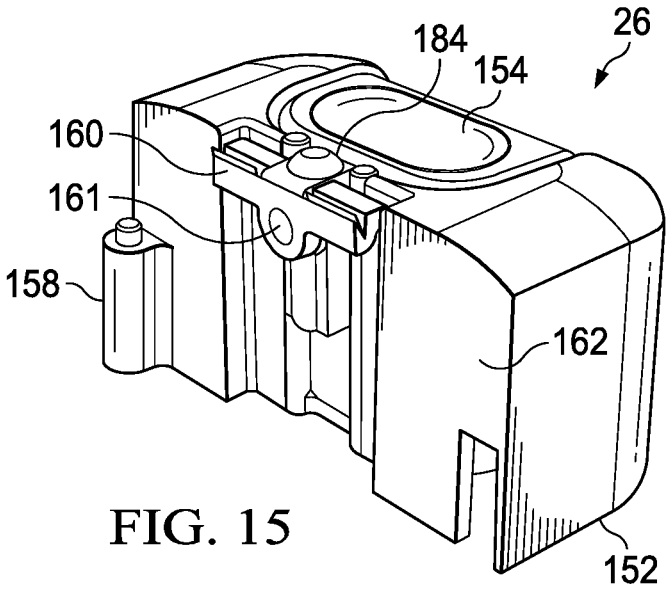
FIG. 15 is an isometric view of the blade eject assembly.
Figure 16:
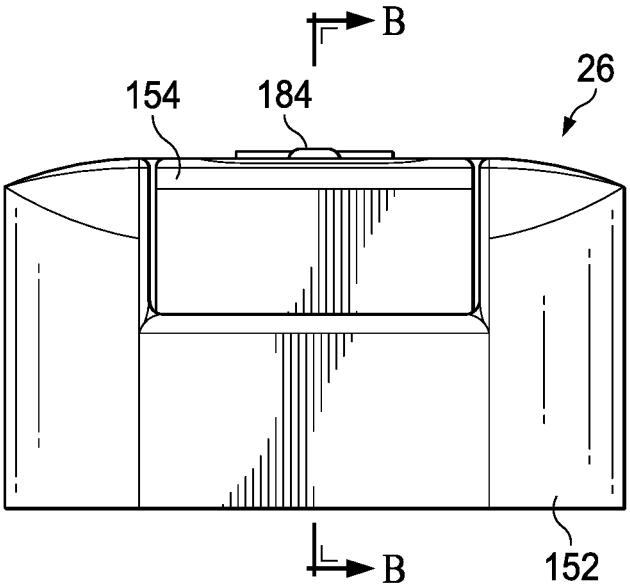
FIG. 16 is an isometric view of the blade eject assembly.
Figure 17:
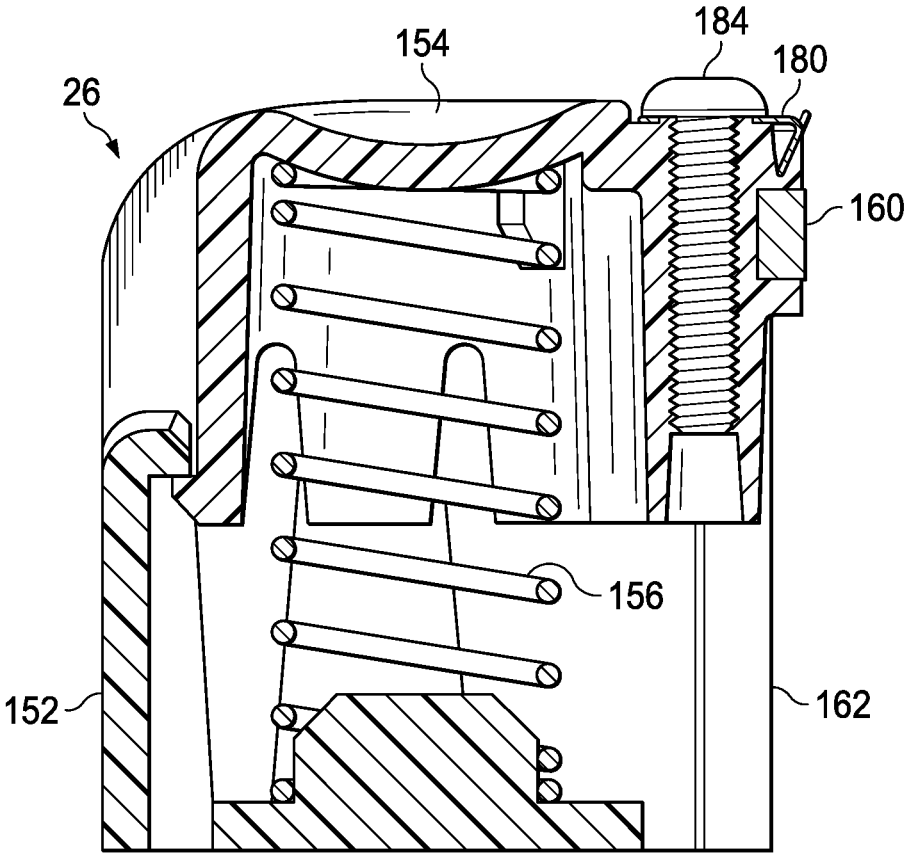
FIG. 17 is a cross-sectional view of the blade eject assembly along line B-B.

Now referring to FIGS. 15, 16, and 17, the blade eject assembly 26 includes base 152, a button 154, and a button biasing member 156. The housing side surface 162 includes a pivot member 158 disposed on a widthwise side configured to engage the blade eject assembly pivot post 62 fixed to the front flange 46. The pivot member 158 and blade eject assembly pivot post 62 cooperate to allow the blade eject assembly 26 to rotate about a pivot axis toward and away from the housing 22, and toward and away from carrier 24 when the carrier 24 is disposed in the carrier cavity 52. FIG. 15 illustrates the pivot member 158 having an additional pivot post which cooperates with the cap 30 to facilitate the aforesaid pivot motion. The male and female arrangement between the pivot posts and pivot member may be alternatively be switched between those elements. The button 154 includes a blade engagement structure 160 configured to engage a blade 21 disposed in the carrier 24 as will be described below; e.g., the engagement structure 160 can be configured to engage the edge of a protective metal cap attached to the blade 21. The blade engagement structure 160 extends outwardly from a housing side surface 162 of the button 154. In some embodiments, the blade engagement structure 160 may include a magnet 161, which magnet 161 facilitates blade handling/movement. The blade engagement structure may further comprise an insert 180 which may be mechanically attached to the blade engagement structure 160 (e.g., by screw 184) to allow for replacement as described below. The button 154 is configured to allow heightwise translation (e.g., vertical translation) of the button 154 relative to the assembly base 152. The button biasing member 156 (e.g., a coil spring) is disposed between an interior surface of the button 154 and an interior surface of the base 152, and biases the button 154 in a height wise direction away from the base 152. FIGS. 1 and 2 show the button 154 biased in the normal position. The button 154 and base 152 include features (e.g., tabs) that limit the relative travel there between and maintain the base 152 and button 154 coupled together. The base 152 further includes structure (e.g., a slot) for engaging the latch 88 of the blade eject assembly latch button 34. The blade eject assembly 26 is not limited to the above-described embodiment; e.g., the assembly may assume a configuration that is selectively attached to and removable from the housing 22 rather than the pivotable arrangement described above.

Figure 18:
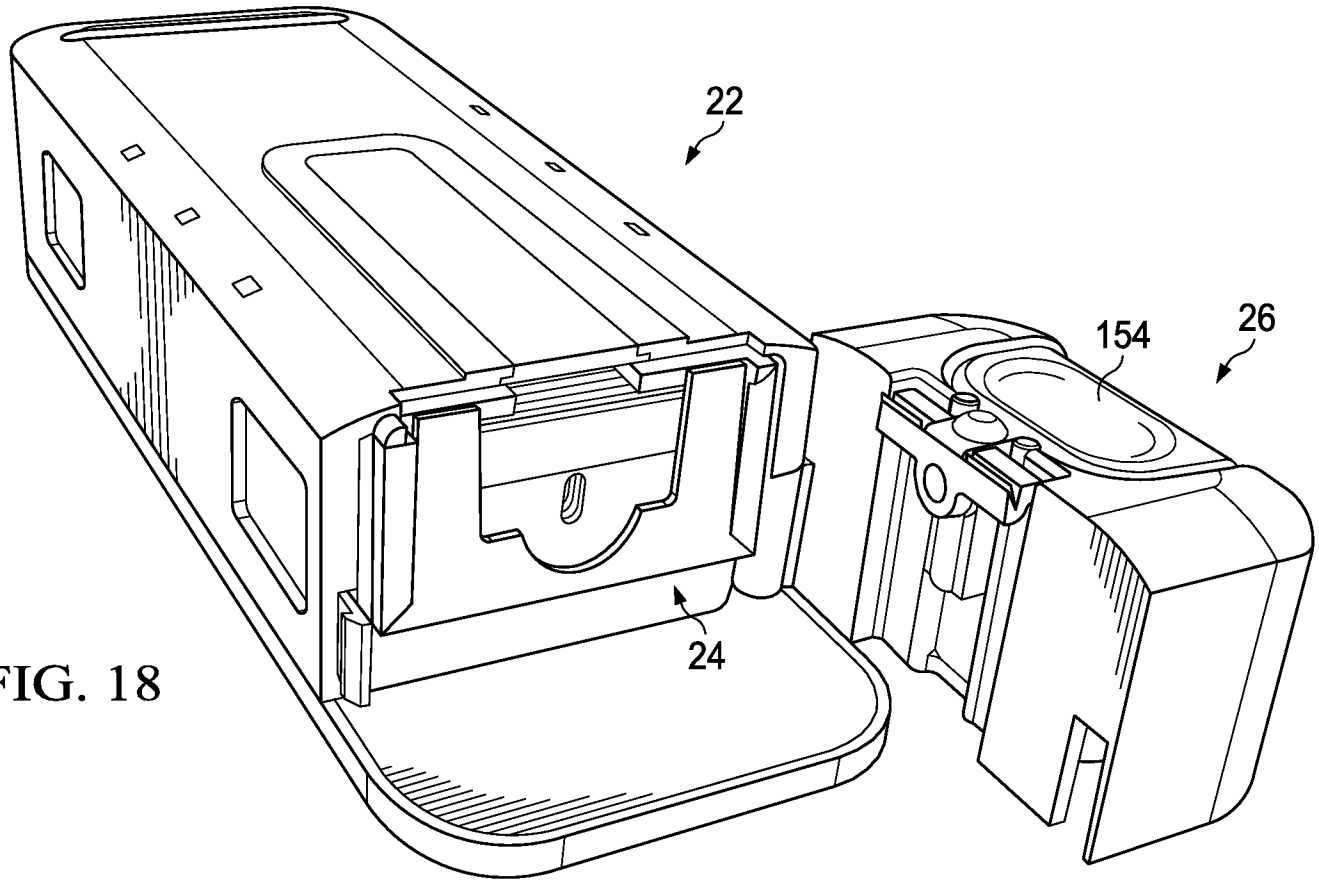
FIG. 18 is an isometric view of a blade dispenser embodiment, illustrating the blade eject assembly in an open position.
Figure 19:
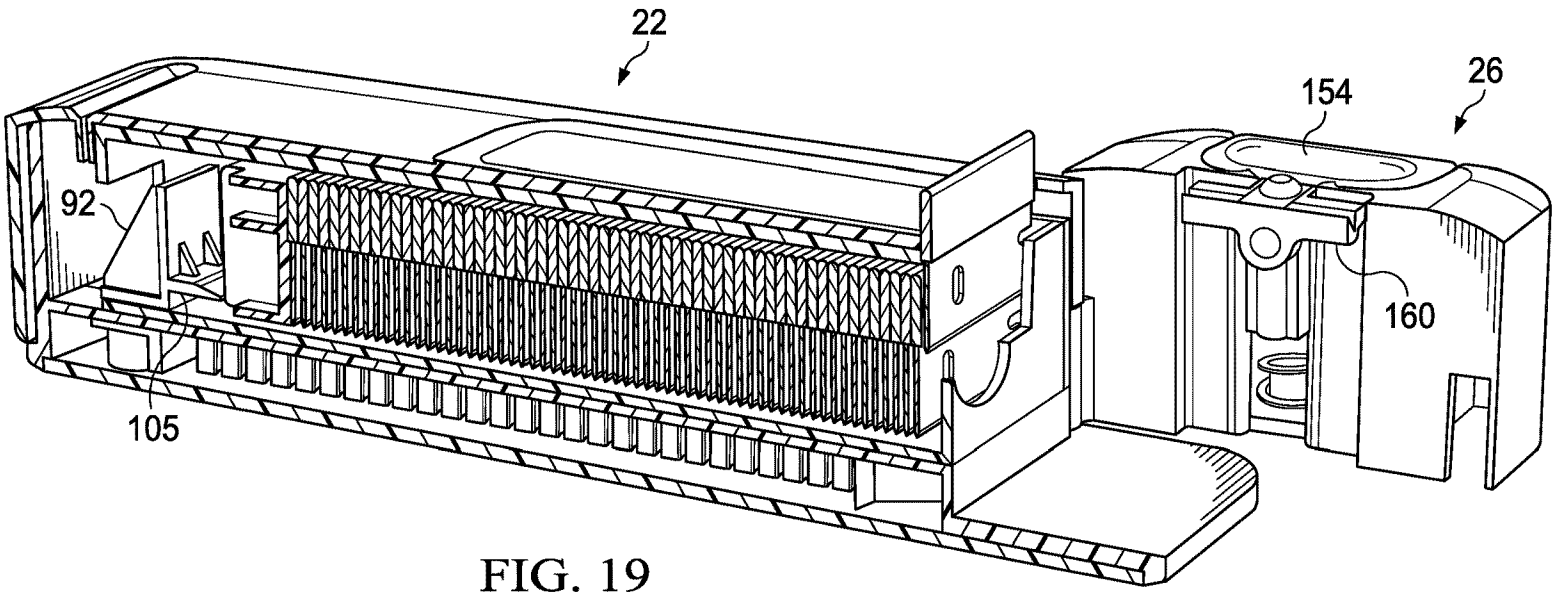
FIG. 19 is a sectional view of a blade dispenser embodiment, illustrating the blade eject assembly in an open position.

FIGS. 18 and 19 illustrate embodiments of the present disclosure. Features of the present disclosure described below may be included in any of embodiments described herein. Embodiments are described below in the context of a blade dispenser 20 (for dispensing individual blades 21) that includes a housing 22, a blade carrier 24, and a blade eject assembly 26.

Now referring to FIGS. 20-23, the blade carrier 24 includes a front panel 122, a pair of side panels 124, a base panel 126, a top panel 128, a back panel 130, a position adjustable dog 132 (e.g., see FIG. 21), and a detent mechanism 134 operable to positionally secure the dog 132. The base panel 126 includes a lengthwise extending slot 136 having a width that is greater than the width of the sled 92 (e.g., see FIG. 20); e.g., to permit the sled 92 to pass through base panel slot 136. The base panel 126 may include a pair of latch slots 138 (e.g., see FIGS. 12 and 22) configured to engage the respective carrier button latch 82. The front panel 122 is configured to receive structure extending out from the blade eject assembly 26; e.g., the carrier front panel 122 shown in FIGS. 20 and 23 includes an opening 142 configured to receive a blade engagement structure portion of a blade eject assembly button 154. The top panel 128 includes a cutout 141 disposed at the forward end of the top panel 128. The cutout 141 and the front panel 122 combine to form a slot 143 (e.g., see FIG. 23). The slot 143 is configured to allow the passage of a razor blade 21 there through. As described above, the side panels 124, base panel 126, and top panel 128 extend lengthwise between the front panel 122 and the back panel 130 to define a blade cavity 144 there between.

Now referring to FIGS. 23, 24, 29A, and 29B in some embodiments the blade carrier 24 includes a one or more features disposed adjacent the front panel 122 to position the blades disposed there at. For example, the top panel 128 may include one or more tabs 145 adjacent the edge of the cutout 141 that are configured to separate the forward most razor blade 21 from the next razor blade 21 within the blade carrier 24 as the forward most razor blade is moved vertically upward as it is being dispensed from the blade carrier 24. In the embodiment shown in FIGS. 23, 24, 29A, and 29B the tabs 64 are shaped to complement the geometry of the razor blade protective cap, but still allow forward travel of the blade 21 once the forward most blade is removed.

Figure 20:
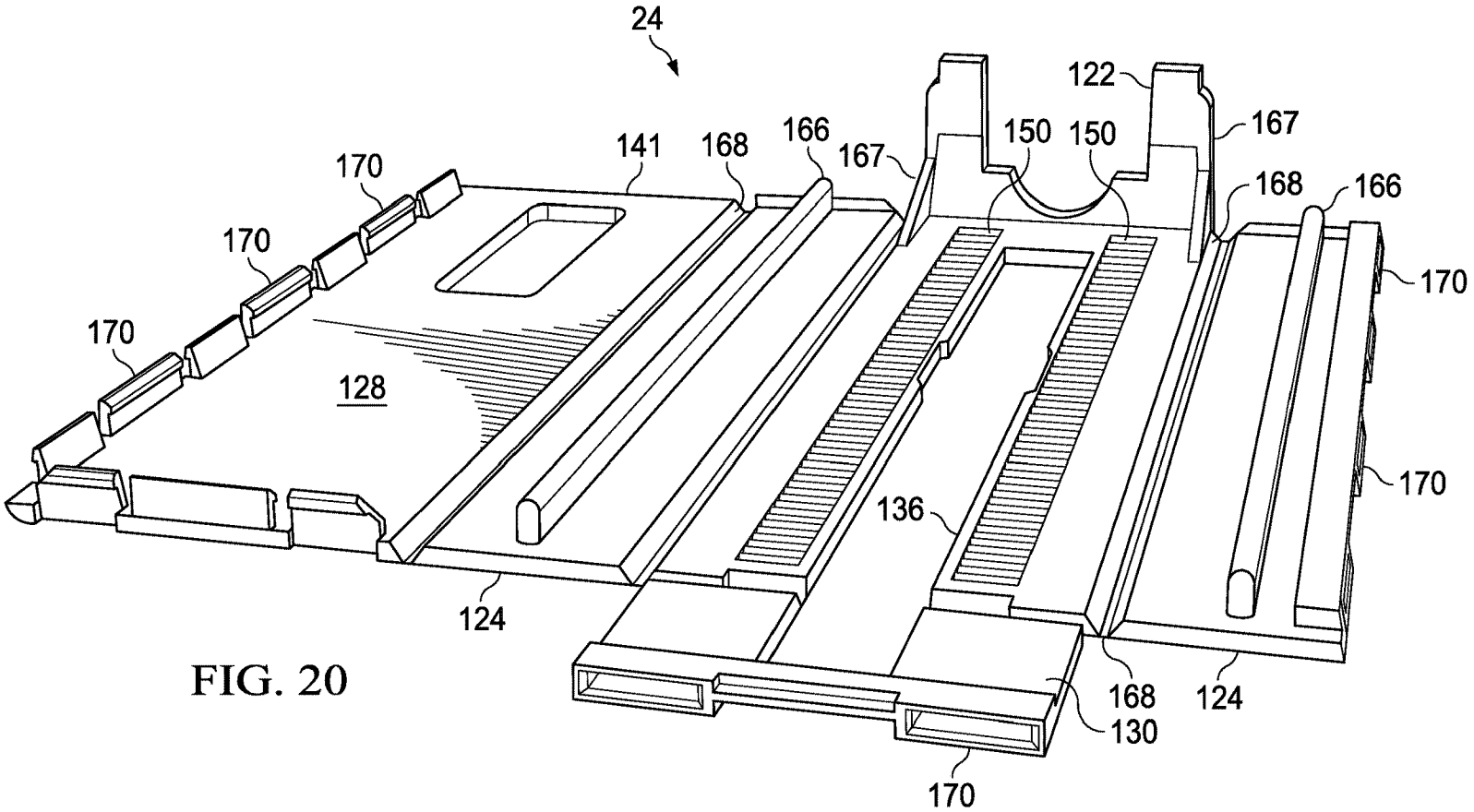
FIG. 20 is a view of a blade carrier embodiment having a unitary body, shown in unassembled form.
Figure 21:
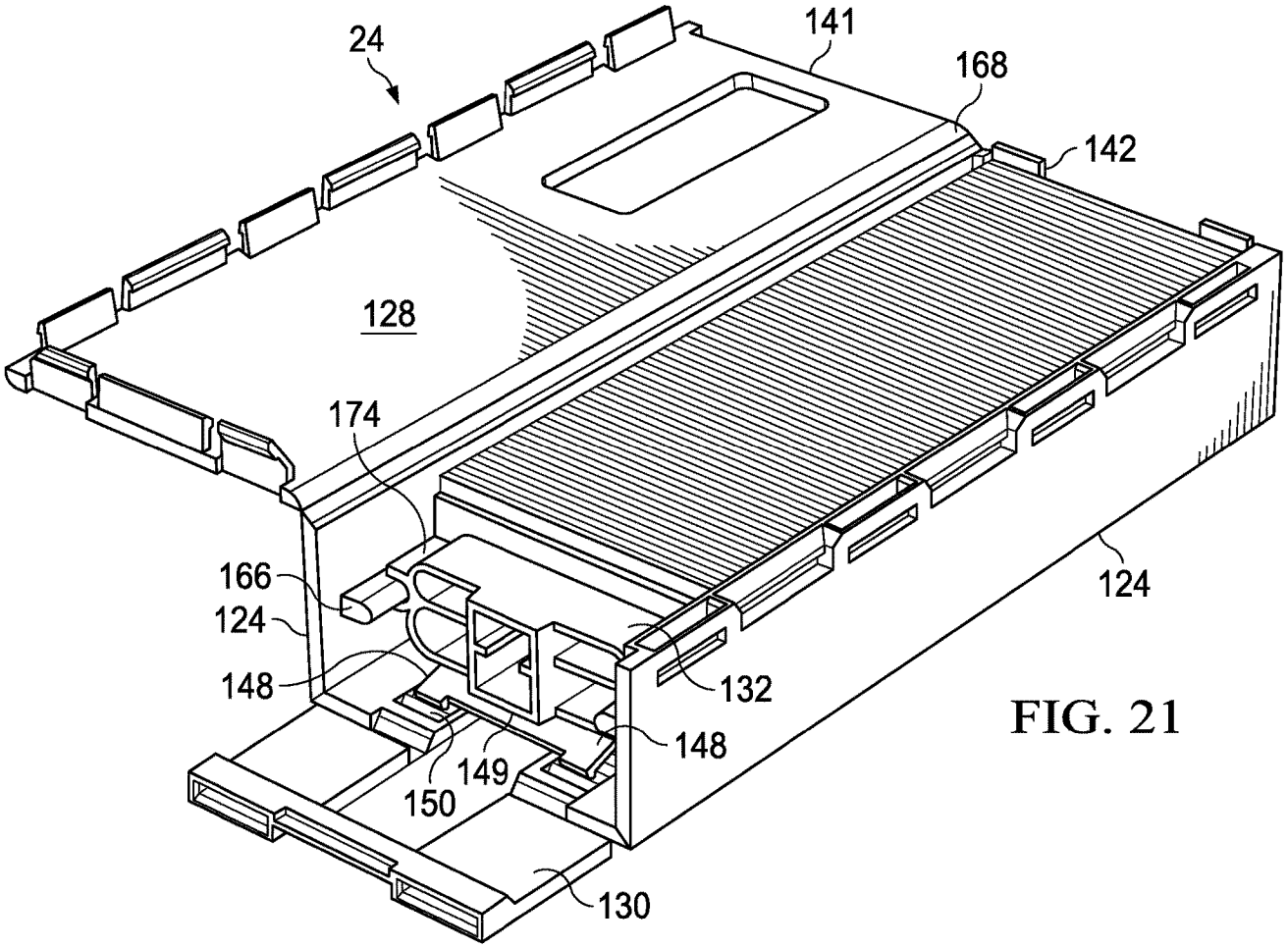
FIG. 21 is a rear isometric view of a blade carrier embodiment having a unitary body, shown in partially assembled form, including razor blades.
Figure 22:
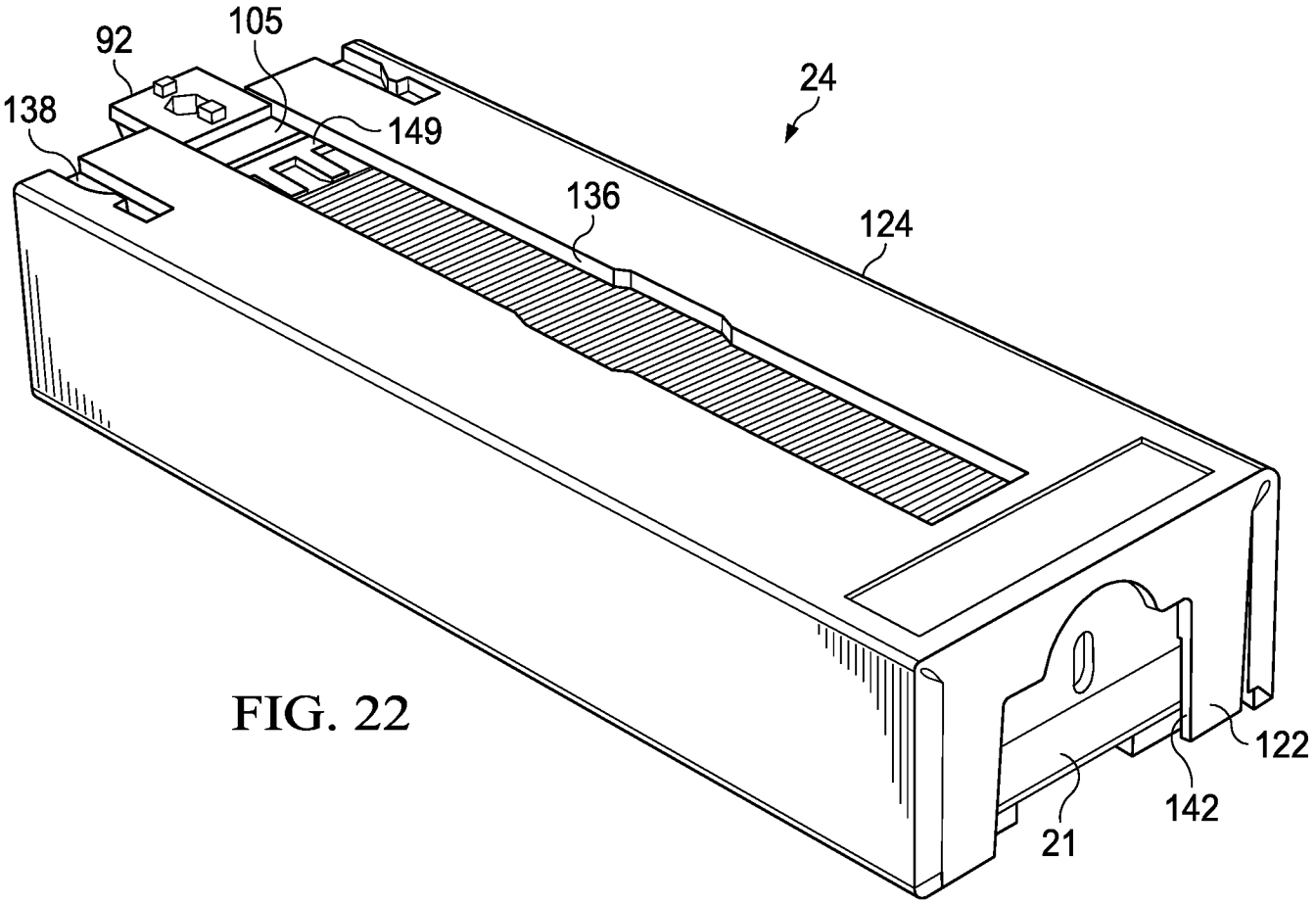
FIG. 22 is a bottom isometric view of a blade carrier embodiment having a unitary body, shown in assembled form, including razor blades and a sled.
Figure 23:
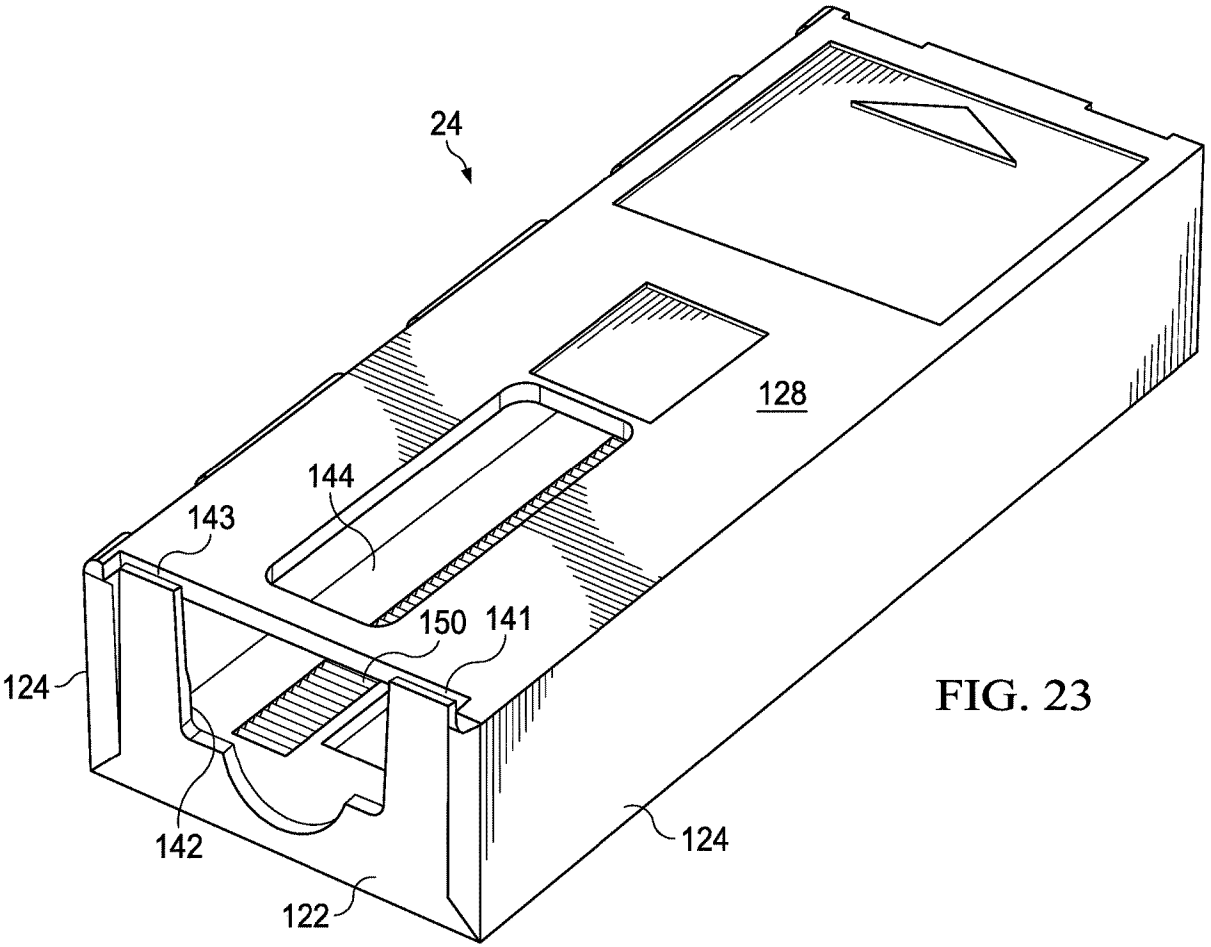
FIG. 23 is a top isometric view of a blade carrier embodiment having a unitary body, shown in assembled form.
Figure 24:
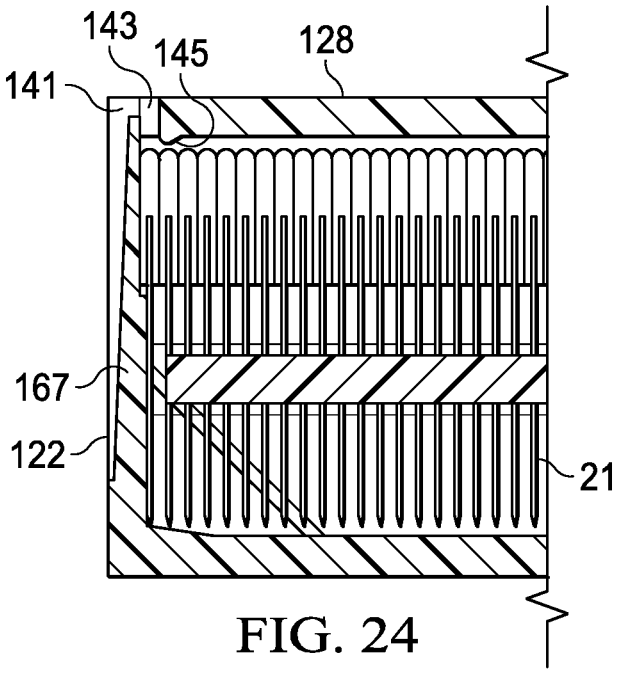
FIG. 24 is a partial sectional view of a blade carrier embodiment.

In some embodiments, the blade carrier 24 may include one or more blade guide features disposed on one or more interior surfaces (i.e., surfaces facing blades disposed within the carrier). For example, as shown in FIGS. 20 and 21, a guide rib 166 extends outwardly from the interior surface of each side panel 124. Each guide rib 166 extends lengthwise and is configured to mate with (e.g., be received in) a cutout disposed on the respective side of each razor blade 21 disposed within the blade carrier 24. The guide ribs 166 may be disposed to support the blades 21 and allow the blades to slide lengthwise along the guide ribs 166, thereby providing clearance between the cutting edges of the blades 21 and the base panel 126 of the blade carrier 24. Additionally, ribs 167 extending outwardly from the interior of the front panel 122 and placed on the edges of the front panel 122 may be used to control the slot 143 that allows blades 21 to pass through. The ribs 167 may engage the cutout 141 portion of the top panel 128 when folded, such that the ribs 167, when engaged with the cutout 141, define the desired size of the slot 143 for passage of blades 21 therethrough. The ribs 167 may be any size and shape desired for controlling the slot 143. In some embodiments, ribs 167 may be affixed to front panel 122 such that ribs 167 may be interchangeable or adjustable. In alternative embodiments, ribs 167 and front panel 122 may comprise one continuous piece. The present disclosure is not limited to the guide features described above. For example, if the blade carrier 24 is configured to hold a razor blade embodiment other than the type shown in FIGS. 20 and 21, the guide features may be configured to mate with guide features (or other blade geometry aspects) present in the type of razor blade.

As can be seen in FIGS. 20 and 21, in some embodiments the blade carrier 24 is constructed to allow assembly of the blade carrier 24 from a unitary body. For example, the unitary body may be a body (e.g., manufactured by molding, stamping, etc.) with respective panels (i.e., side panels 124, base panel 126, top panel 128, and back panel 130) connected to one another by integral hinges 168. The unitary body may further include attachment features 170 (e.g., mechanical features, etc.) that allow the respective panels to attach to one another to form the assembled blade carrier 24. The unitary body facilitates manufacturing of the blade carrier 24.

Figure 25A:
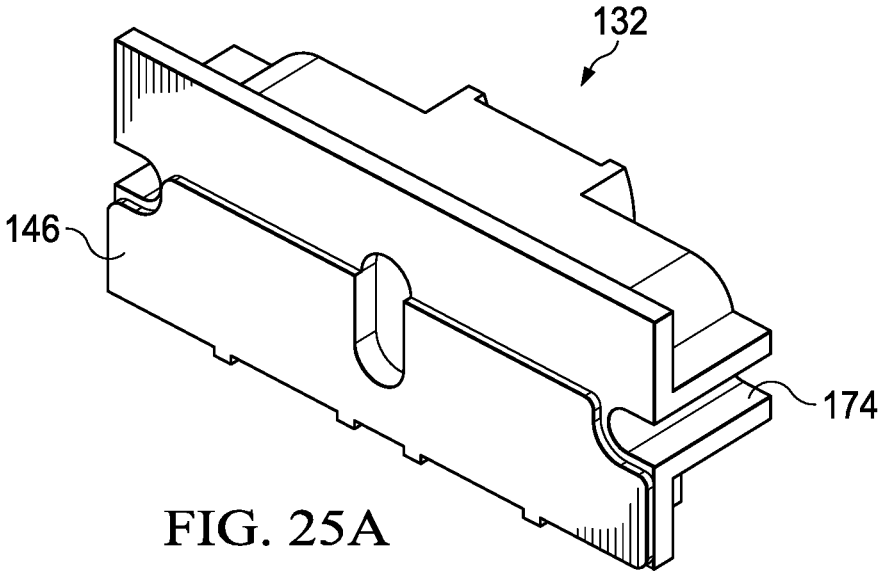
FIGS. 25A, 25B, and 25C are isometric views of a position adjustable dog.
Figure 25B:
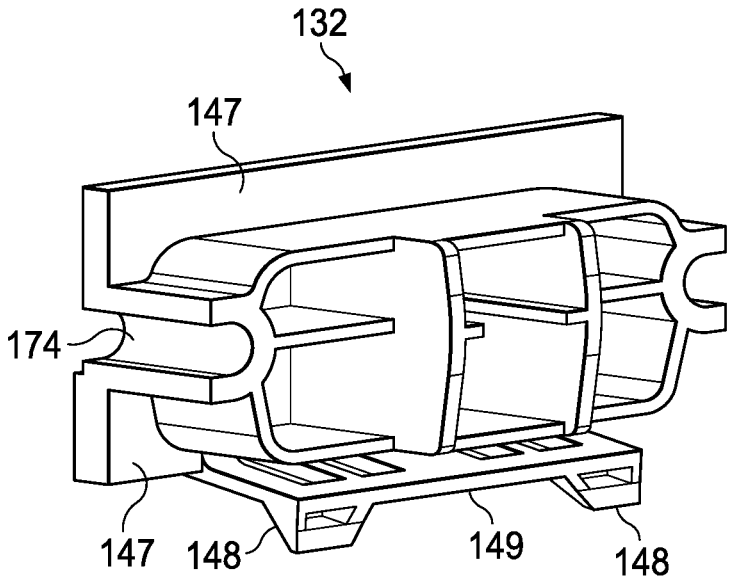
Figure 25C:
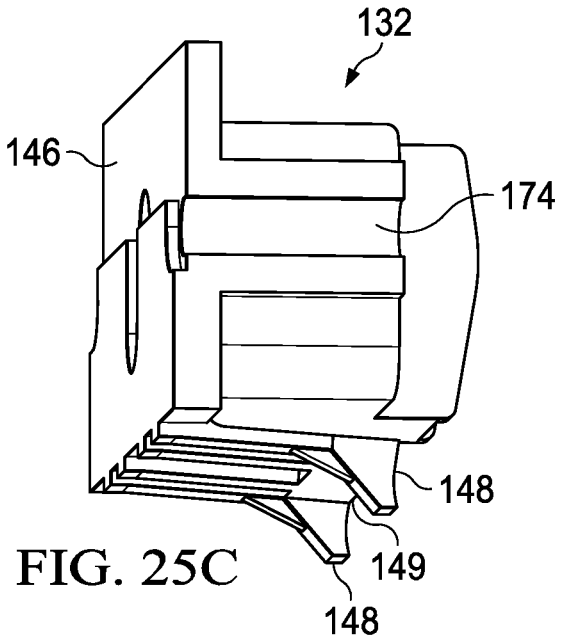
Figure 26:
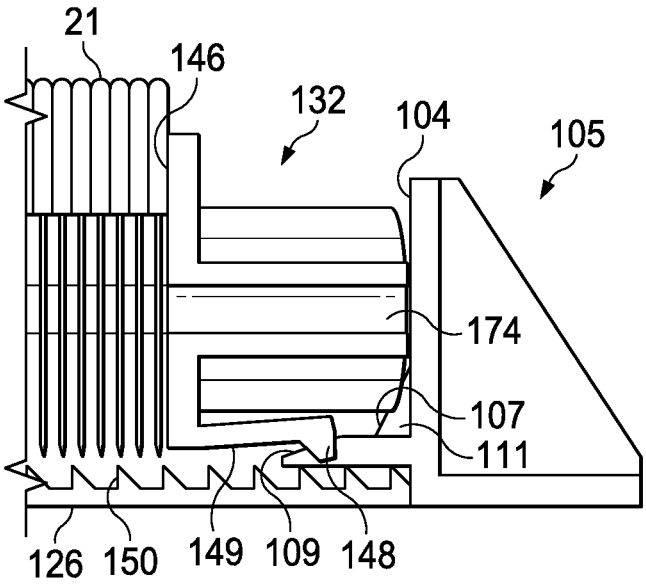
FIG. 26 is a cross-sectional view of the disengaged detent mechanism.

Referring to FIGS. 14A, 14B, 20, 21, 25A, 25B, 25C, 26, and 27, the detent mechanism 134 is operable to positionally secure the dog 132, and may include a first portion (e.g., pawls 148) extending from a surface on the follower latch 149 away from the follower latch 149 and a second portion (e.g., rows of teeth 150) disposed on the interior of the base panel 126 of the blade carrier 24. The pawls 148 contact the rows of teeth 150 to form the detent mechanism 134. As discussed above, the detent mechanism 134 embodiment shown in FIGS. 14A, 14B, 20, and 21 includes a pair of pawls 148 disposed on a follower latch 149 affixed to the underside of the dog 132 and a corresponding pair of rows of teeth 150 disposed on the interior surface of the base panel 126. Each pawl 148 may engage with a mating row of 150 on the interior of the base panel 126 positioned relative thereto. The dog 132 may be pushed forward towards the front panel 122 to secure the blades 21 within the blade carrier 24 if desired (e.g., while shipping the blade carrier 24). The follower latch 149 extends away from the front flange 147 of the dog 132 at an angle sufficient to allow the pawls 148 to engage the rows of teeth 150. The pawls 148 extend away from the follower latch 149 to engage the corresponding rows of teeth 150 disposed on the interior surface of the base panel 126 to form the detent mechanism 134. This engagement latches and secures the dog 132 in place, such that the dog 132 resists movement towards the back panel 130 of the carrier 24. With reference to FIG. 26, when the blade dispenser 20 (shown on FIG. 1) is desired for use, the cam 105 on sled 92 may be biased towards the dog 132 to engage the follower latch 149 disposed on the dog 132 such that the pawls 148 disposed on the follower latch 149 of the dog 132 are disengaged from the corresponding teeth rows 150 disposed on the interior surface of the base panel 126; thus disengaging the detent mechanism 134 described above. The referenced disengagement occurs because the ramped portion 109 of the contact surface 107 of the cam 105 engages the flower latch 149 to induce movement of the follower latch 149 (and consequently pawls 148) away from the rows of teeth 150. As the follower latch 149 is moved away from the rows of teeth 150, the pawls 148 disengage from the rows of teeth 150 and the detent mechanism 134 is disabled. As such the cam 105 may be used to unlatch the dog 132 so that it is no longer secured by the detent mechanism 134.

Figure 27:
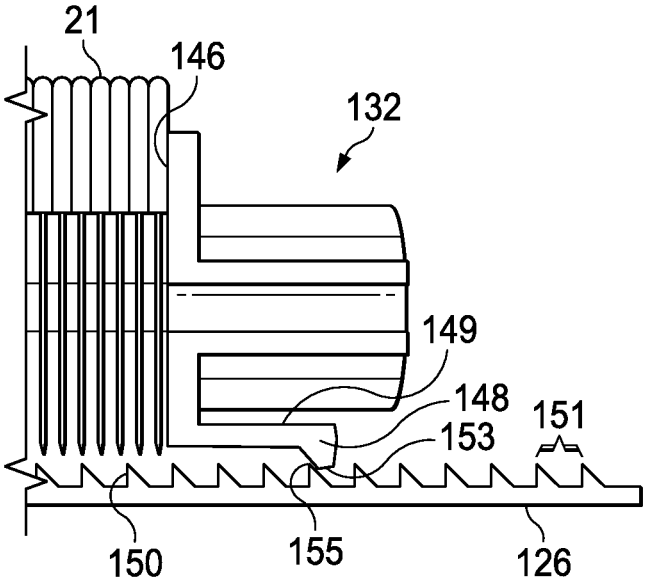
FIG. 27 is a cross-sectional view of the detent mechanism.

With reference to FIG. 27, the row of teeth 150 comprises a feed pitch 151. The feed pitch 151, is the distance between the outermost edge of the plateau of the peak of an individual tooth within a row of teeth 150 and the outermost edge of the valley adjacent to the next tooth in the series as illustrated in FIG. 27. In embodiments, the feed pitch 151 may be a distance greater than the thickness of one blade 21. In embodiments, the overlap between the length of a pawl 148 at its tip 153 and the length of an individual tooth in a row of teeth 150 at its tip 155 is such that the overlap of the respective tip lengths 153 and 155 may be less than the thickness of one blade 21. In embodiments, having an overlap of tip lengths 153 and 155 less than the thickness of one bade 21 may allow the pawl 148 to return to the valley portion of the feed pitch 151 and not rest on the tip 155 of an individual tooth within the row of teeth 150. As such, the pawl 148 may always rest in the valley of the feed pitch 151 when not engaged with the cam 105. The present disclosure is not limited to this particular detent mechanism 134 embodiment.

As illustrated by FIGS. 25A, 25B, and 25C, the dog 132 may include guide features 174 that mate with the guide ribs 166 extending outwardly from the interior surfaces of the blade carrier 24. The respective mating guide features 166, 174 of the blade carrier 24 and the dog 132 facilitate relative movement.

Figure 28:
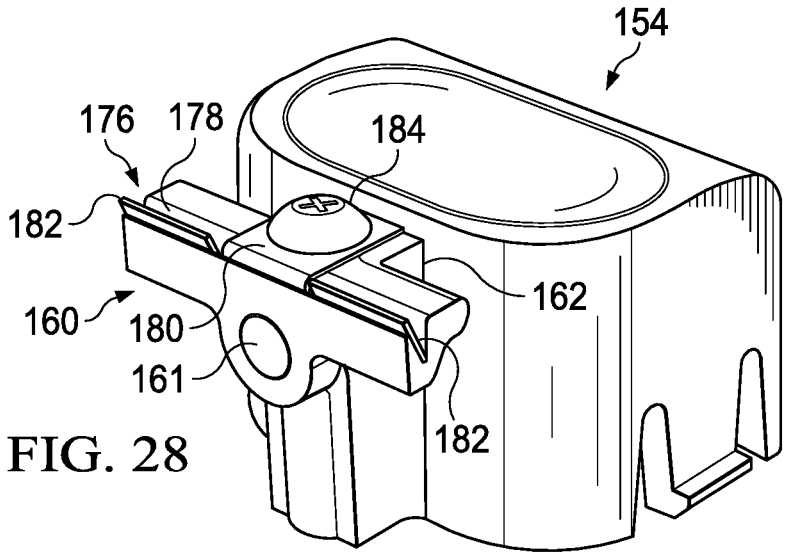
FIG. 28 is an isometric view of a blade eject assembly button embodiment.
Figure 29:
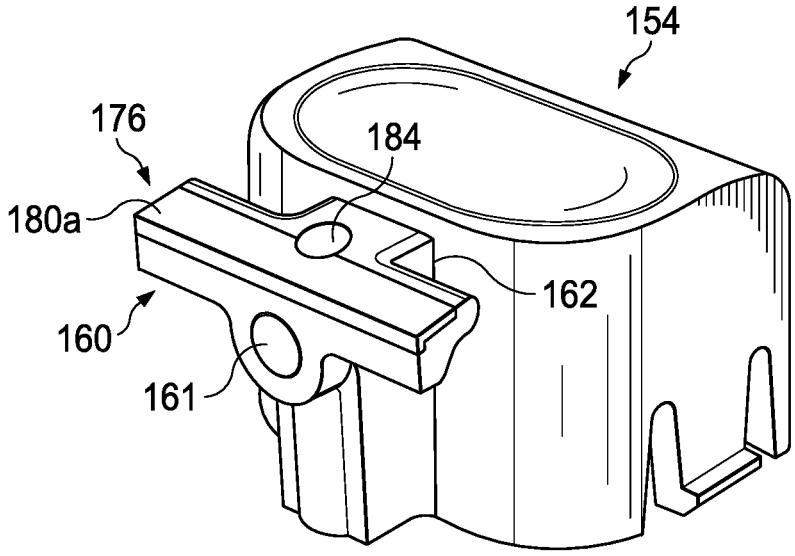
FIG. 29 is an isometric view of a blade eject assembly button embodiment.
Figure 30B:
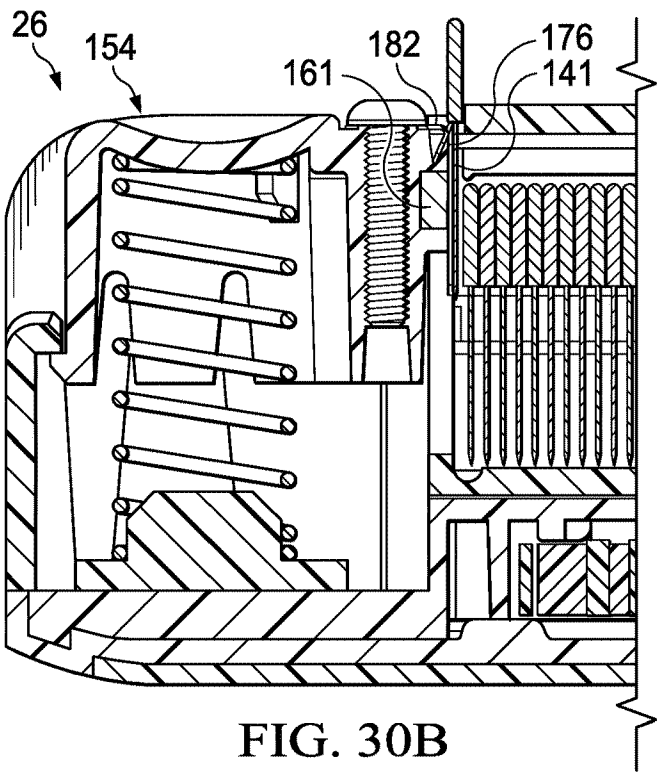
FIG. 30B is a partial sectional view of a blade dispenser embodiment, illustrating the blade eject assembly button in a non-depressed position.
Figure 30A:
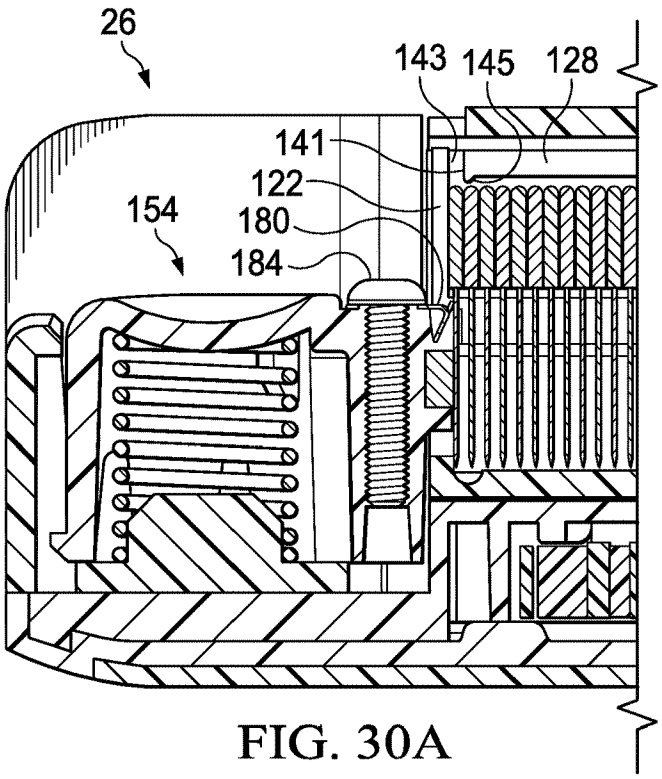
FIG. 30A is a partial sectional view of a blade dispenser embodiment, illustrating the blade eject assembly button in a depressed position.

Now referring to FIGS. 17, 28, 29, 30A, and 30B, in some embodiments the blade eject assembly 26 may include a blade eject assembly button 154 with a blade engagement structure 160 configured to engage a blade 21 disposed in the carrier 124. The blade engagement structure 160 is configured to engage the edge of the protective metal cap attached to a razor blade 21. The blade engagement structure 160 extends outwardly from a housing side surface 162 of the button 154, and includes a widthwise extending member 176 and a magnet 161. The widthwise extending member 176 has a length substantially equal to the width of a razor blade 21. In the embodiments shown in FIGS. 17 and 28, the member 176 includes a slot 178 (e.g., V-shaped) disposed in a top surface of the member 176. In some embodiments, the blade engagement structure 160 further includes an insert 180 with at least one contactor 182 (two contactors are shown in FIG. 28) extending outwardly from the slot 178. The insert 180 may be comprised of a material that has a greater wear-resistance (e.g., greater hardness) than the material of the blade engagement structure 160. Preferably, the insert 180 is comprised of a hardened material (e.g., steel) that is wear-resistant. The insert 180 may be mechanically attached to the blade engagement structure 160 (e.g., by screw 184) to allow for replacement. The present disclosure is not limited to a blade engagement structure 160 having the configuration described above. For example, the blade engagement structure 160 may not include an insert, or may include an insert 180*a* that provides a wear resistant edge (e.g., greater hardness material as described above) as shown in FIG. 29.

Now referring FIGS. 1-30B, the general operation of the blade dispenser 20 in terms of one or more of the embodiments described above will now be described to further illustrate the utility of the present disclosure. To facilitate the description of the general operation of the blade dispenser 20, the following description does not specifically refer to each embodiment described above but is applicable to all embodiments unless specifically stated otherwise. The order of operation provided hereinafter is for description purposes only and is not limiting.

The dog 132 is moved within the carrier 24 toward the back panel 130, away from the front panel 122. A plurality of blades 21 is loaded into the carrier blade cavity 144 between the dog 132 and the front panel 122, with the sharp edges of the blades 21 proximate the base panel 126 of the carrier 24. The carrier 24 is not limited to any particular blade capacity, and the same blade dispenser 20 may be used with different capacity carriers 24 for different applications. In addition, a carrier 24 with a blade capacity of "N" blades (where "N" is an integer) may be loaded with less than "N" blades. Once the blades are loaded in the carrier 24, the dog 132 is moved forward snug against the rearward most blade 21.

FIG. 1 (and FIGS. 30A and 30B) shows the blade eject assembly 26 in a "closed" position; i.e., rotated to enclose the carrier cavity 52. In this position, the blade eject assembly latch button latch 88 is normally biased into engagement with slot disposed in the blade eject assembly base 152 by the blade eject latch button biasing mechanism 60 of the housing 22. When a user depresses the blade eject assembly latch button 34, the button pivots, the biasing mechanism 60 deflects, and the latch 88 disengages with the slot in the button base 152. Once disengaged, the blade eject assembly 26 can be rotated away from the housing 22 causing the carrier cavity 52 to be exposed. This position of the blade eject assembly 26 relative to the housing 22 may be referred to as the "open position".

The loaded carrier 24 is subsequently slid into the carrier cavity 52. Prior to sliding the carrier 24 into the carrier cavity 52, the blade loading mechanism sled 92 is biased forward, toward the open end 54 of the carrier cavity 52. As the carrier 24 is slid into the carrier cavity 52, the sled 92 is received within the carrier base panel slot 136 (i.e., extending at least partially into the blade cavity) until the sled 92 contacts the dog 132. As the carrier 24 is slid further into the carrier cavity 52, the sled 92 and carrier 24 are moved lengthwise aft toward the endwall panel 42 of the housing 22. As the sled 92 is moved backward, the blade loading mechanism 36 biases the sled 92 against the dog 132. More specifically, the flexible member 94 rotates around the pivotable member 96, which movement is resisted by the biasing element 98 thereby providing the force that biases the sled 92 against the dog 132. As the sled 92 is biased against the dog 132, the detent mechanism 134 used to secure dog 132 may be disengaged by the engagement of the cam 105 of the sled 92 with the follower latch 149 of the dog 132.

As the carrier 24 is completely inserted into the carrier cavity 52, the latches of the carrier buttons 32A, 32B engage the latch slots 138 disposed in the carrier 24. Further lengthwise movement of the carrier 24 causes the carrier button latches 82 to encounter the ramped tooth 140 in each slot 138. Once the carrier button latches 82 pass the ramped teeth 140, the carrier latch biasing mechanisms 58 (e.g., the cantilevered tabs) attached to the housing 22 force the latches 82 widthwise outwardly and the carrier 24 is then secured in the carrier cavity 52 by the latches 82. The blade eject assembly 26 can then be rotated toward the housing 22 to enclose the carrier cavity 52. As the blade eject assembly 26 is rotated toward the housing 22 (i.e., toward the closed position), the assembly engages the blade eject assembly latch button 34 which subsequently prevents the assembly 26 from rotating away from the housing 22. In the closed position, a gap 164 (through which blades may be dispensed; see FIG. 1) remains between the top panel 118 of the cap 30 and the housing side surface 162 of the blade eject assembly button 154. Also, when the blade eject assembly 26 is in the closed position the blade engagement structure 160 of the button 154 (which extends out from the housing side surface) contacts a portion of the forward most blade 21 in the carrier 24.

When a user wishes to dispense a blade 21 from the blade dispenser 20, she depresses the blade eject assembly button 154. When the button 154 and blade engagement structure 160 are depressed sufficiently, the blade engagement structure 160 engages a feature (e.g., the protective metal cap attached to the blade) on the forward most blade 21 in the carrier 24. When the user releases the blade eject assembly button 154, the blade engagement structure 160 travels upwardly with the button 154 and causes the engaged blade 21 to also travel upwardly and enter the gap 164 between the top panel of the housing 22 and the housing side surface 162 of the blade eject assembly button 154. When the maximum height wise upward travel of the button 154 is completed, a portion of the engaged blade 21 is exposed where it can be readily and safely gripped by two fingers of the user and removed from the blade dispenser 20. When the blade 21 is removed from the carrier 24 (and therefore the dispenser), the sled 92 biased against the carrier dog 132 forces the carrier dog 132 forward thereby moving the then most forward blade 21 in the carrier 24 into a "to be dispensed" position. Thereafter, the blade dispenser 20 is ready to dispense the forward most blade 21.

When the user desires to remove the carrier 24 (e.g., because it is empty or to change the type of blade 21 being dispensed), the user depresses the blade eject assembly latch button 34 which causes the blade eject assembly latch button latch 88 to disengage with the blade eject assembly 26. Once disengaged, the blade eject assembly 26 can be rotated away into the open position, thereby exposing the carrier 24. The user may then depress the carrier buttons 32A, 32B. When the carrier buttons 32A, 32B are sufficiently depressed, the carrier button latches 82 disengage with the ramped teeth 140 in slots 138 disposed in the carrier 24 and the carrier 24 can be removed from the blade dispenser housing 22.

Although specific embodiments of the disclosure have been shown and described, it will be understood by those skilled in the art that various changes in form and detail may be made without departing from the spirit and scope of the disclosure. For example, the disclosure includes embodiments of the blade dispenser 20 wherein the carrier 24 is inserted and removed from a forward portion of the device. In alternative embodiments, the carrier 24 may alternatively be accessed from a side vantage. As another example, the disclosure details that a blade eject assembly latch button 34 portion of the housing includes structure that engages blade eject assembly 26 to hold the blade eject assembly 26 relative to the housing 22. In an alternative embodiment, the blade eject assembly 26 may include structure that engages the housing 22 to hold the blade eject assembly 26 relative to the housing 22.

What is claimed is:

1. A blade dispenser, comprising:

a housing defining a carrier cavity having an open end, the housing having a blade loading mechanism; wherein the blade loading mechanism includes a sled, a flexible member, a pivotable member, and a biasing element; wherein the sled comprises a cam;

a carrier operable to hold a plurality of blades and selectively disposable within the carrier cavity of the housing; wherein the carrier comprises a dog capable of being selectively positioned at lengthwise positions within the carrier; wherein the cam is capable of contacting a follower latch disposed on the dog; and a blade eject assembly having a button biased in a normal position relative to a base, wherein the button is operable to be moved relative to the base and engage a blade disposed within the carrier and move the blade to a position where at least a part of the blade is accessible from an exterior of the housing;

wherein the blade eject assembly includes a blade engagement structure attached to the blade eject assembly button, the blade engagement structure being configured to engage one of the plurality of blades which the carrier is operable to hold;

wherein the blade engagement structure extends outwardly from blade eject assembly button, and includes a widthwise extending member having a length substantially equal to a width of the plurality of blades which the carrier is operable to hold;

wherein the widthwise extending member includes a slot disposed in a top surface of the member.

2. The blade dispenser of claim 1, wherein the contact of the cam and the follower latch induces the follower latch to be moved away from a position the follower latch had prior to contact with the cam.

3. The blade dispenser of claim 1, wherein the carrier further comprises a row of teeth positioned lengthwise along a base panel of the carrier cavity, and wherein the row of teeth are configured to engage a pawl disposed on the follower latch.

4. The blade dispenser of claim 3, wherein the sled is capable of being biased against the dog such that a ramped portion of the cam contacts the follower latch of the dog, and wherein, the contact of the ramped portion of the cam with the follower latch induces the disengagement of the pawl with the row of teeth.

5. The blade dispenser of claim 3, wherein the row of teeth comprises a feed pitch greater than the thickness of one blade.

6. The blade dispenser of claim 3, wherein an overlap of a length of a tip of the pawl and a length of a tip of a tooth within the row of teeth is less than a thickness of one blade.

7. The blade dispenser of claim 1, wherein the carrier comprises a row of teeth, wherein the follower latch comprises a pawl, wherein the row of teeth comprises a feed pitch greater than a thickness of one blade, and wherein an overlap of a length of a tip of the pawl and a length of a tip of a tooth within the row of teeth is less than the thickness of the one blade.

8. The blade dispenser of claim 1, wherein the blade eject assembly is selectively positionable relative to the housing in an open position and in a closed position, wherein the blade eject assembly is pivotally mounted to the housing, and the housing includes at least one blade eject assembly latch button operable to secure the blade eject assembly relative to the housing.

9. The blade dispenser of claim 1, wherein the carrier includes one or more panels that define a blade cavity sized to contain a plurality of blades, the blade cavity having across-sectional geometry that accommodates the blades held within the carrier, wherein the one or more panels includes a top panel and a front panel configured to receive a portion of the blade eject assembly button; wherein a slot is disposed between the top panel and the front panel.

10. The blade dispenser of claim 1, wherein the housing has a floor panel having a carrier surface and a bottom surface, the bottom surface being disposed opposite the carrier surface, and the floor panel including a lengthwise extending slot, the slot extending through the floor panel between the carrier surface and the bottom surface; and wherein the sled is configured for travel along the lengthwise extending slot disposed in the floor panel.

11. The blade dispenser of claim 10, wherein the sled includes a slot member extending between a bottom surface flange and a blade flange, the slot member being received within the lengthwise extending slot disposed in the housing floor panel, and the bottom surface flange is disposed adjacent the bottom surface of the housing floor panel, and the blade flange is disposed adjacent the carrier surface of the housing floor panel; wherein the cam extends outwardly from the blade flange; and wherein the flexible member is attached the bottom surface flange of the sled, and extends around at least a portion of the pivotable member, and the biasing element is operable to bias the sled toward the open end of the carrier cavity of the housing.

12. The blade dispenser of claim 1, further comprising a selectively removable insert having at least one contactor, wherein the insert is attached to the blade engagement structure and the contactor extends outwardly from the slot.

13. The blade dispenser of claim 1, wherein the carrier is a unitary structure that includes a plurality of panels and each panel is connected to another panel by a hinge, and the panels are configured to assemble and define a blade cavity sized to contain a plurality of blades, the blade cavity having a cross-sectional geometry that accommodates the blades held within the carrier.

14. The blade dispenser of claim 13, wherein the housing further comprises a cap and a base; wherein the cap and the base at least partially define the carrier cavity; wherein the base comprises posts; wherein the cap comprises holes; wherein the posts a capable engaging the holes to align the cap with the base.

15. A blade dispenser, comprising:

a housing defining a carrier cavity having an open end, the housing including a blade loading mechanism; wherein the blade loading mechanism includes a sled, a flexible member, a pivotable member, and a biasing element; wherein the sled comprises a blade flange and a cam; wherein the cam comprises a contact surface having, a ramped portion at a joinder portion; wherein the ramped portion is angled toward the flexible member; wherein the cam further comprises a web member coupled to the blade flange and the joinder portion;

a carrier operable to hold a plurality of blades and selectively disposable within the carrier cavity of the housing; and a blade eject assembly having a button biased in a normal position relative to a base, wherein the batten is operable to be moved relative to the base and engage a blade disposed within the carrier and move the blade to a position where at least a part of the blade is accessible from an exterior of the housing;

wherein the blade elect assembly, includes a blade engagement structure attached to the blade elect assembly button, the blade engagement structure being configured to engage one of the plurality of blades which the carrier is operable to hold;

wherein the blade engagement structure extends outwardly from blade eject assembly button, and includes a widthwise extending member having a length substantially equal to a width of the plurality of blades which the carrier is operable to hold;

wherein the widthwise extending member includes a slot disposed in a top surface of the member.

16. A blade dispenser, comprising:

a housing defining a carrier cavity having an open end;

a carrier operable to hold a plurality of blades and selectively disposable within the carrier cavity of the housing; wherein the carrier comprises a row of teeth disposed lengthwise along an interior of the carrier; wherein the carrier further comprises a dog capable of being selectively positioned at lengthwise positions within the carrier; wherein the dog comprises a follower latch; wherein the follower latch comprises a pawl; and wherein the follower latch is angled on the dog such that the pawl of the follower latch is engaged with the row of teeth; and a blade eject assembly having a button biased in a normal position relative to a base, wherein the button is operable to be moved relative to the base and engage a blade disposed within the carrier and move the blade to a position where at least a part of the blade is accessible from an exterior of the housing;

wherein the blade eject assembly includes a blade engagement structure attached to the blade eject assembly button, the blade engagement structure being configured to engage one of the plurality of blades which, the carrier is operable to hold;

wherein the blade engagement structure extends outwardly front blade eject assembly button, and includes a widthwise extending member having a length substantially equal to a width of the plurality of blades which the carrier is operable to hold;

wherein the widthwise extending member includes a slot disposed in a top surface of the member.

17. The blade dispenser of claim 15, further comprising a selectively removable insert having at least one contactor, wherein the insert is attached to the blade engagement structure and the contactor extends outwardly from the slot.

18. The blade dispenser of claim 16, further comprising a selectively removable insert having at least one contactor, wherein the insert is attached to the blade engagement structure and the contactor extends outwardly from the slot.

* * * * *